US011614275B2

(12) United States Patent
Choi

(10) Patent No.: US 11,614,275 B2
(45) Date of Patent: Mar. 28, 2023

(54) REFRIGERATOR

(71) Applicant: LG Electronics Inc., Seoul (KR)

(72) Inventor: Kwanghyun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 9 days.

(21) Appl. No.: 17/329,750

(22) Filed: May 25, 2021

(65) Prior Publication Data

US 2021/0278127 A1 Sep. 9, 2021

Related U.S. Application Data

(63) Continuation of application No. 17/027,270, filed on Sep. 21, 2020, now Pat. No. 11,047,619, which is a (Continued)

(30) Foreign Application Priority Data

May 8, 2018 (KR) ..... 10-2018-0052722

(51) Int. Cl.
*F25D 25/02* (2006.01)
*F25D 23/02* (2006.01)
(Continued)

(52) U.S. Cl.
CPC ..... *F25D 25/025* (2013.01); *F25D 23/028* (2013.01); *F25D 23/04* (2013.01); *F25D 11/02* (2013.01); *F25D 2323/02* (2013.01)

(58) Field of Classification Search
None
See application file for complete search history.

(56) References Cited

U.S. PATENT DOCUMENTS 5,586,816 A 12/1996 Geiss, II
7,581,796 B2 9/2009 Jeong et al.
(Continued)

FOREIGN PATENT DOCUMENTS

CN 107388718 11/2017
EP 3505854 3/2019
(Continued)

OTHER PUBLICATIONS

EP Extended European Search Report in European Appln. No. 19166936.5, dated Sep. 3, 2019, 9 pages.
(Continued)

*Primary Examiner* — Hanh V Tran
(74) *Attorney, Agent, or Firm* — Fish & Richardson P.C.

(57) ABSTRACT

A refrigerator includes a cabinet that defines a lower storage space, a front panel door part, a drawer part connected to the front panel door part, a support member located at the drawer part and configured to seat one or more objects stored in the drawer part, at least one draw-out rail that is configured to connect the drawer part to an inner wall surface of the lower storage space, and that is configured to extend and retract in multiple stages to assist insertion and withdrawal of the drawer part based on movement of the front panel door part, and at least one elevation device that is located at each of both side surfaces of the drawer part, that is connected to each of both sides of the support member, and that is configured to elevate the support member relative to the drawer part.

20 Claims, 27 Drawing Sheets

Related U.S. Application Data continuation of application No. 16/406,118, filed on May 8, 2019, now Pat. No. 10,876,788.

(51) Int. Cl.
*F25D 23/04* (2006.01)
*F25D 11/02* (2006.01)

(56) References Cited

U.S. PATENT DOCUMENTS

| | | | | |
|---|---|---|---|---|
| 7,628,461 | B2 | 12/2009 | Carden et al. | |
| 7,810,891 | B2 | 10/2010 | Lee et al. | |
| 9,377,238 | B2 | 6/2016 | Hall et al. | |
| 9,795,276 | B2 | 10/2017 | Park et al. | |
| 10,234,195 | B2 * | 3/2019 | Yasaka | F25D 25/025 |
| 10,465,970 | B1 | 11/2019 | Kang et al. | |
| 10,598,425 | B2 | 3/2020 | Choi et al. | |
| 10,598,426 | B2 * | 3/2020 | Kang | F25D 25/025 |
| 10,598,428 | B2 | 3/2020 | Kim | |
| 10,627,156 | B2 * | 4/2020 | Kang | F25D 25/025 |
| 10,648,727 | B2 * | 5/2020 | Kim | F25D 25/025 |
| 11,002,478 | B2 * | 5/2021 | Kang | F25D 25/025 |
| 11,243,025 | B2 * | 2/2022 | Choi | F25D 23/028 |
| 2006/0021373 | A1 | 2/2006 | Oh et al. | |
| 2006/0022564 | A1 | 2/2006 | Oh et al. | |
| 2006/0043848 | A1 * | 3/2006 | Jeong | A47B 67/04 312/310 |
| 2006/0043849 | A1 * | 3/2006 | Oh | F25D 25/025 312/310 |
| 2006/0087207 | A1 * | 4/2006 | Oh | A47B 51/00 312/401 |
| 2006/0103273 | A1 * | 5/2006 | Lee | A47B 51/00 312/236 |
| 2006/0104756 | A1 * | 5/2006 | Kim | A47B 51/00 312/401 |
| 2006/0196198 | A1 * | 9/2006 | Kim | A47B 51/00 62/131 |
| 2006/0207283 | A1 | 9/2006 | Kim et al. | |
| 2006/0242988 | A1 * | 11/2006 | Kim | F25D 25/04 62/441 |
| 2008/0203041 | A1 | 8/2008 | Lim et al. | |
| 2009/0151380 | A1 * | 6/2009 | Oh | F25D 25/025 62/449 |
| 2012/0306338 | A1 | 12/2012 | Nagahata et al. | |
| 2013/0081421 | A1 | 4/2013 | Kwon et al. | |
| 2013/0300275 | A1 | 11/2013 | Chellappan et al. | |
| 2014/0021845 | A1 * | 1/2014 | Wehner | F25D 25/025 312/319.1 |
| 2014/0021847 | A1 | 1/2014 | Wehner et al. | |
| 2014/0239789 | A1 | 8/2014 | Rehage et al. | |
| 2014/0265797 | A1 | 9/2014 | Scheming et al. | |
| 2014/0265798 | A1 | 9/2014 | Watts | |
| 2014/0265806 | A1 | 9/2014 | Hall et al. | |
| 2015/0076985 | A1 | 3/2015 | Yoo et al. | |
| 2017/0292778 | A1 | 10/2017 | Lee | |
| 2019/0219324 | A1 | 7/2019 | Kang | |
| 2019/0292831 | A1 | 9/2019 | Choi | |
| 2019/0293340 | A1 | 9/2019 | Choi | |
| 2019/0293341 | A1 | 9/2019 | Yeom | |
| 2019/0301789 | A1 | 10/2019 | Kim | |
| 2019/0323763 | A1 * | 10/2019 | Kang | F25D 25/025 |
| 2021/0055042 | A1 * | 2/2021 | Chung | F25D 17/065 |

FOREIGN PATENT DOCUMENTS

| | | |
|---|---|---|
| KR | 1020060031113 | 4/2006 |
| KR | 1020060053420 | 5/2006 |
| KR | 20060107665 | 10/2006 |
| KR | 1020080101335 | 11/2008 |
| KR | 1020110080874 | 7/2011 |

OTHER PUBLICATIONS

Office Action in Korean Appln. No. 10-2018-0052722, dated Apr. 13, 2022, 13 pages (with English translation).

* cited by examiner

REFRIGERATOR

CROSS-REFERENCE TO RELATED APPLICATIONS

The present application is a continuation of U.S. application Ser. No. 17/027,270, filed on Sep. 21, 2020, which is a continuation of U.S. application Ser. No. 16/406,118, filed on May 8, 2019, now U.S. Pat. No. 10,876,788, which claims priority under 35 U.S.C. 119 and 35 U.S.C. 365 to Korean Patent Application No. 10-2018-0052722, filed on May 5, 2018. The disclosures of the prior applications are incorporated by reference in their entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a structure provided with an elevatable storage container on a rear surface of a withdrawable door is disclosed in Korean Patent Publication No. 10-2008-0101335. However, in this structure, a connection portion between the door and the storage container may be exposed, and electrical devices and structures for the elevation may be exposed to cause serious problems of safety in use.

In addition, force for the elevation is substantially applied to a front end of the storage container. Also, when foods are stored in the accommodation container, it is difficult to perform stable elevation of the accommodation container due to an eccentric load applied to the storage container, and serious deformation and breakage of the door and the storage container may occur.

Also, a structure in which a basket is elevated by an operation of a support member provided on a door is disclosed in Korean Patent Publication No. 10-2006-0053420. In this structure, a support member is exposed directly from a rear surface and a bottom surface of the door to cause problems in safety in use.

Also, a structure for lifting a basket is provided on a front surface of the door. Thus, if a load exists at a lower portion of the basket, the basket may be separated. Thus, it is difficult to provide an effective and stable supporting and elevating structure.

Also, a structure in which a fixed frame and a movable frame are disposed on a rear surface of a door, and a pneumatic cylinder is provided on each of both sides of the fixed frame to elevate a basket by elevating the movable frame fixed to the basket is disclosed in Korean Patent Publication No. 10-2006-0031113.

However, if the pneumatic cylinder disposed on each of both the sides is not accurately controlled, the basket may be tilted. Particularly, when an eccentric load is applied to the basket, the basket may not be elevated due to the eccentricity of the basket.

Also, in this structure, since the pneumatic cylinder is exposed to each of both left and right sides, there may also be safety issues. In addition, a volume within the basket may be reduced by the pneumatic cylinder and the movable frame, which are disposed on each of both the sides.

Also, according to the related art, the basket having the accommodation space or the entire structures corresponding to the basket are elevated. In this structure, the load may be eccentric according to the arrangement of the foods in the accommodation space. Thus, when being elevated, an unbalance may occur.

Also, the basket has to be completely withdrawn from the accommodation space within the refrigerator so as to elevate the entire basket. Also, the insertion and the withdrawal of the basket may be unstable due to an increase in a draw-out distance of the entire door including the basket, and thus, a reinforcement structure such as a rail for supporting the door may be required. Particularly, such a limitation may be exacerbated when the structures for the elevation are provided on the door side.

SUMMARY

Embodiments provide a refrigerator in which a portion within a drawer door, which is withdrawn in a drawer type, is elevated to improve user's convenience in use.

Embodiments also provide a refrigerator in which an elevation assembly for elevating a support member on which a food is seated in a drawer-type door is provided on each of both sides of the drawer-type door to elevate the support member without being tilted and improve safety in use and operation reliability.

Embodiments also provide a refrigerator in which an electrical device for elevation is disposed in a front panel door part of a drawer door, and a mechanism part connected to the electrical device and elevated is disposed in a drawer part to improve safety.

Embodiments also provide a refrigerator in which an electrical device for elevation and a mechanism part are not generally exposed to the outside to improve an outer appearance and safety in use.

Embodiments also provide a refrigerator in which a drawer part in which a mechanism part is disposed and a front panel door part in which an electrical device is disposed are coupled to be selectively separated from each other and thereby to improve assembling workability, cleanability, and serviceability.

Embodiments also provide a refrigerator in which elevation is performed in a state in which only a portion of a front portion of a drawer part of a drawer is exposed without withdrawing an entire drawer part to perform the elevation in a stable withdrawal state.

Embodiments also provide a refrigerator in which at least a portion of an elevation assembly for elevating a support member is provided in a drawer part to minimize a loss in storage capacity of a drawer part.

Embodiments also provide a refrigerator which has a structure in which a support member is elevated while minimizing a loss of a storage space within a drawer door.

Embodiments also provide a refrigerator in which a structure for elevation is minimally exposed to realize a neat and elegant outer appearance.

Embodiments also provide a refrigerator which has a structure capable of covering an elevation assembly disposed on each of both sides so as to elevate a support member, thereby improving an outer appearance and safety.

Embodiments also provide a refrigerator in which a maximum draw-out distance and elevation distance are secured without allowing structures for elevating a support member within a drawer part to interfere with each other.

According to one aspect of the subject matter described in this application, a refrigerator includes: a cabinet that defines an upper storage space and a lower storage space; a front panel door part configured to open and close at least a portion of the lower storage space by moving away from and toward the lower storage space, respectively; a drawer part that is connected to the front panel door part, that is configured to insert into the lower storage space based on the front panel door part moving toward the lower storage space, and that is configured to withdraw from the lower storage space based on the front panel door part moving away from the lower storage space, the drawer part defining a drawer space therein; a support member located at the drawer part and configured to seat one or more objects stored in the drawer part; at least one draw-out rail that is configured to connect the drawer part to an inner wall surface of the lower storage space, and that is configured to extend and retract in multiple stages to assist insertion and withdrawal of the drawer part based on movement of the front panel door part; and at least one elevation device that is located at each of both side surfaces of the drawer part, that is connected to each of both sides of the support member, and that is configured to elevate the support member relative to the drawer part.

Implementations according to this aspect may include one or more of the following features. For example, the at least one draw-out rail may be located at a lower end of the drawer part and configured to extend horizontally along a front direction and a rear direction with respect to the lower storage space, where the at least one elevation device is located vertically above the at least one draw-out rail and extends in a vertical direction that crosses the draw-out rail.

In some implementations, the front panel door part may include a door frame that extends from each of both sides of the front panel door part toward the drawer part and that is configured to couple the front panel door part to the drawer part, where the door frame is configured to be mounted to a lower portion of the drawer part at each of the both side surfaces of the drawer part in a state in which the door frame is coupled to the at least one draw-out rail.

In some implementations, the drawer part may include at least one rail mounting part to which the at least one draw-out rail is configured to be mounted, the at least one rail mounting part being located at a lower end of an outer surface of the drawer part. In some examples, each of the at least one rail mounting part may include: a top surface portion that extends outward from the outer surface of the drawer part and that is configured to face a top surface of the at least one draw-out rail; and a side surface portion that extends downward from an outer end of the top surface portion and that defines an accommodation space configured to receive the at least one draw-out rail.

In some examples, each of the at least one draw-out rail may include: a first fixing rail configured to be fixed to the at least one rail mounting part; a second fixing rail disposed vertically below the first fixing rail and configured to be fixed to the inner wall surface of the lower storage space; and an intermediate rail that slidably interconnects the first fixing rail to the second fixing rail and that is configured to move with respect to the first fixing rail and to the second fixing rail.

In some implementations, the drawer part defines at least one elevation device mounting part that is recessed from an inner surface of the drawer part, that is configured to receive the at least one elevation device, and that has a shape corresponding to a shape of the at least one elevation device, where the at least one elevation device mounting part extends from an upper side of the at least one rail mounting part to an upper end of the drawer part. In some examples, the at least one elevation device mounting part is recessed from an inner surface of the drawer part by a recessed depth, where the at least one rail mounting part protrudes toward the outer surface of the drawer part by a length that is equal to the recessed depth of the at least one elevation device mounting part.

In some examples, the drawer part may include at least one drawer flange that extends from an upper end of each of the both side surfaces of the drawer part. For each of the at least one drawer flange, the draw-out rail and the elevation device may be disposed inside of a mounting space that is defined vertically below the drawer flange, and the drawer flange defines an opening that faces the elevation device mounting part. The refrigerator may further include at least one mounting part bracket configured to couple with the at least one drawer flange, and to restrict an upper end of the at least one elevation device in a state in which the at least one elevation device is mounted to the at least one elevation device mounting part.

In some examples, each of the at least one elevation device may include: a housing configured to couple to the at least one elevation device mounting part; an elevation shaft that is rotatably located inside of the housing, that extends in a vertically direction, and that defines a screw thread at an outer circumferential surface thereof; an elevation holder that is penetrated by the elevation shaft, that is located inside of the housing, and that is configured to move in the vertical direction along a length of the elevation shaft; and a connecting bracket that protrudes to an outside of the drawer part and that is configured to connect the elevation holder to each of the both sides of the support member.

In some implementations, the refrigerator may further include: a motor assembly located at the front panel door part and configured to power to the at least one elevation device; and a door-side shaft that extends from the motor assembly to a first lateral side of the front panel door part and to a second lateral side of the front panel door part, and that is configured to transmit power from the motor assembly to the at least one elevation device.

In some examples, the refrigerator may further include at least one drawer-side shaft that is located in the mounting space defined vertically below the at least one drawer flange. For each of the at least one drawer-side shaft: the drawer-side shaft is configured to connect an end of the door-side shaft to an end of the elevation shaft; the end of the door-side shaft is configured to engage with an end of the drawer-side shaft by gears that are configured to transmit power to the drawer-side shaft; and the drawer-side shaft extends in a direction crossing the door-side shaft and the elevation shaft.

In some implementations, the drawer part defines at least one shaft mounting part that is configured to receive the at least one drawer-side shaft, and that is located between the at least one elevation device mounting part and a front end of each of the both side surfaces of the drawer part, where each of the at least one shaft mounting part is disposed inside the mounting space defined vertically below each of the at least one drawer flange. In some examples, the at least one shaft mounting part may be disposed at an outer circumferential surface of the drawer part corresponding to each of the both side surfaces of the drawer part. For each of the at least one shafting mounting part, the elevation device mounting part may define an opening that interfaces with the shaft mounting part, and the drawer-side shaft may be configured to pass through the opening and to connect to the elevation device through the opening.

In some implementations, the refrigerator may further include at least one outer side plate that defines at least a portion of an outer appearance of the drawer part and that faces each of the both side surfaces of the drawer part, where each of the at least one outer side plate is configured to cover the rail mounting part, the elevation device mounting part, and the shaft mounting part.

In some implementations, the refrigerator may further include: a plurality of reinforcement ribs that extend outward from each of the both side surfaces of the drawer part; and at least one outer side plate that is configured to be mounted to each of the both side surfaces of the drawer part, that defines at least a portion of an outer appearance of the drawer part, and that is configured to cover each of the both side surfaces of the drawer part in a state in which the at least one elevation device and the at least one draw-out rail are mounted to each of the both side surfaces of the drawer part. The plurality of reinforcement ribs may be configured to support the at least one outer side plate. In some examples, the at least one outer side plate is made of a first material, where the refrigerator further may include a plurality of inner side plates that are made of the first material and that define an inner surface of the drawer part.

In some implementations, the drawer part is configured to divide an inside of the drawer part into a front space in which the support member is disposed, and a rear space defined behind the front space in a direction in which the front panel door part is inserted, where the at least one draw-out rail is configured to withdraw the drawer part to a position in which the front space is disposed outside of the lower storage space, and in which at least a portion of the rear space remains in the lower storage space.

In some implementations, the refrigerator may further include a motor assembly located in the front panel door part and configured to supply power to the at least one elevation device. The front panel door part may define: an insulation space configured to accommodate an insulation material; and a recess part recessed from a rear surface of the front panel door part and configured to accommodate the motor assembly.

In some examples, the motor assembly may include: a motor case; a motor that is mounted within the motor case, the motor including a rotation shaft that extends in a direction crossing the rear surface of the front panel door part; a plurality of gears that are connected to the rotation shaft of the motor and that are connected to each other at vertical positions; and a door-side shaft that passes through the motor case and extends laterally to both sides of the front panel door part, that is coupled to one of the plurality of gears, and that is configured to transmit power to the at least one elevation device. The plurality of gears may be configured to convert a rotation speed of the motor to a shaft rotation speed.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
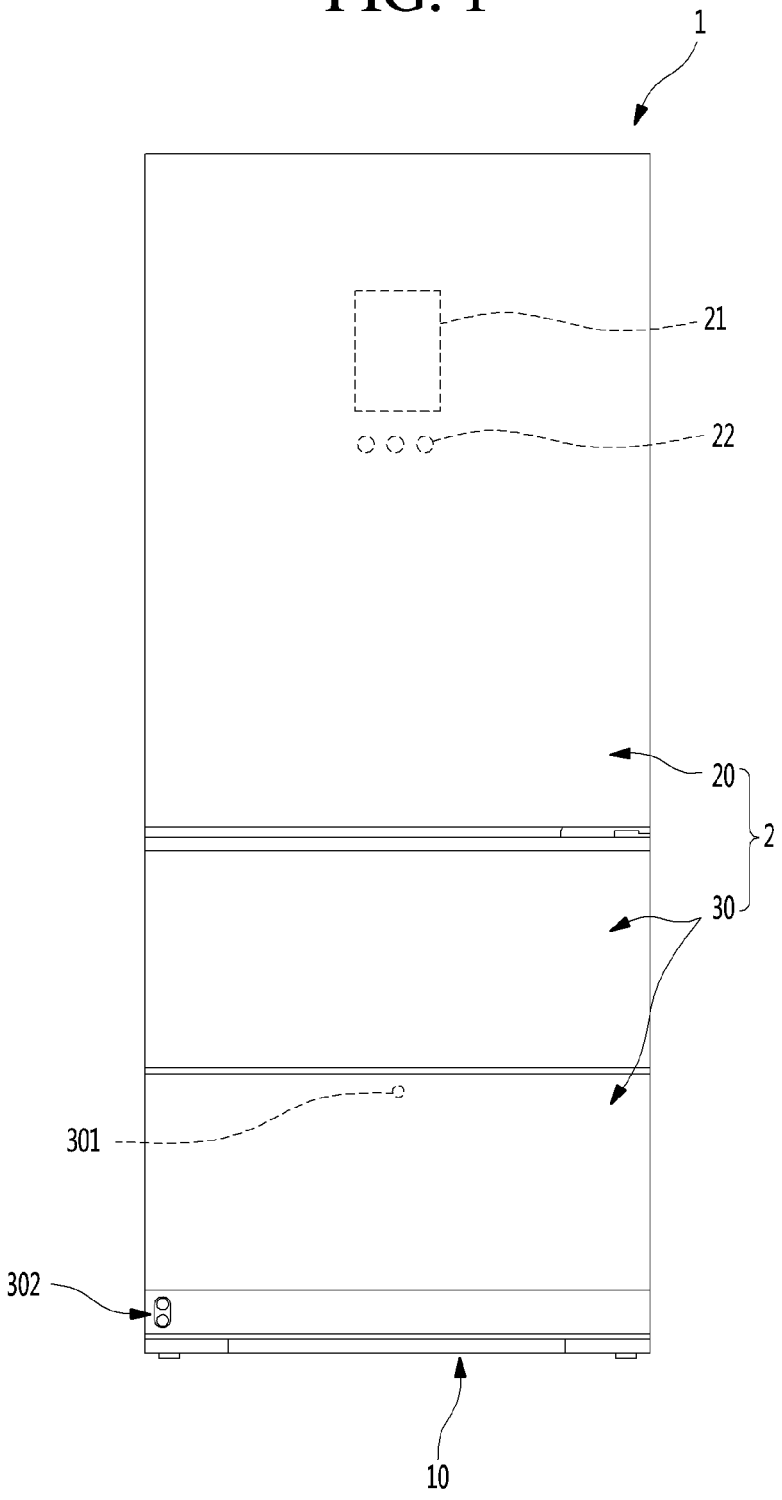
FIG. 1 is a front view of a refrigerator according to an embodiment.

FIG. 1 is a front view of a refrigerator according to an embodiment.

As illustrated in the drawing, the refrigerator 1 may have an outer appearance that is defined by a cabinet 10 defining a storage space and a door 2 covering an opened front surface of the cabinet 10.

The storage space of the cabinet 10 may be divided into a plurality of spaces. For example, an upper space of the cabinet 10 may be provided as a refrigerating compartment, and a lower space of the cabinet 10 may be provided as a freezing compartment. Each of the upper space and the lower space may be provided as an independent space that is maintained at a different temperature, except for the refrigerating compartment and the freezing compartment. The upper space and the lower space may be called an upper storage space and a lower storage space.

The door 2 may be constituted by a rotation door 20 opening and closing the upper space through rotation thereof and a drawer door 30 opening and closing the lower space by being inserted or withdrawn in a drawer type. The lower space may be vertically divided again. The drawer door 30 may be constituted by an upper drawer door 30 and a lower drawer door 30. Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type.

A display 21 may be disposed on one side of a front surface of the rotation door 20. The display 21 may have a liquid crystal display structure or an 88 segment structure. Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation of a support member 35 within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30 to illuminate an image on a bottom surface and thereby to output a virtual switch and to input an operation in such a manner that the user approaches a corresponding area.

The lower drawer door 30 may be automatically inserted and withdrawn according to the manipulation of the manipulation part 301. Also, a food or container 36 within the lower drawer door 30 may be elevated in a state in which the drawer door 30 is withdrawn by the manipulation of the manipulation part 301.

That is, the automatic insertion and withdrawal and/or automatic elevation of the lower drawer door 30 may be performed by at least one of a plurality of manipulation devices 22, 301, and 302. As necessary, only one of the plurality of manipulation devices 22, 301, and 302 may be provided.

Hereinafter, the lower drawer door 30 will be described in more detail, and also, the lower drawer door 30 will be called a drawer door unless otherwise specified.

Figure 2:
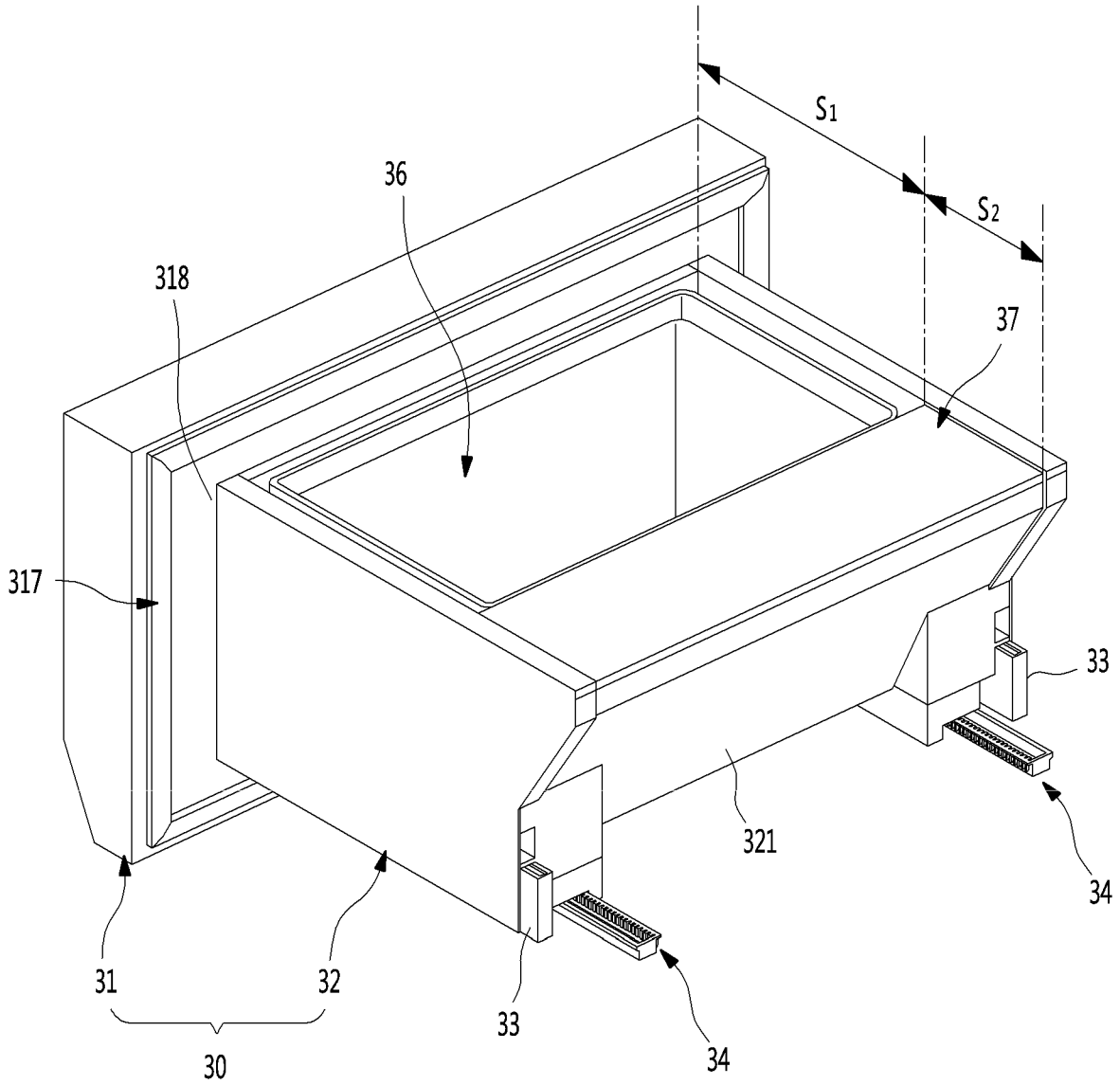
FIG. 2 is a perspective view of a drawer door according to an embodiment.
Figure 3:
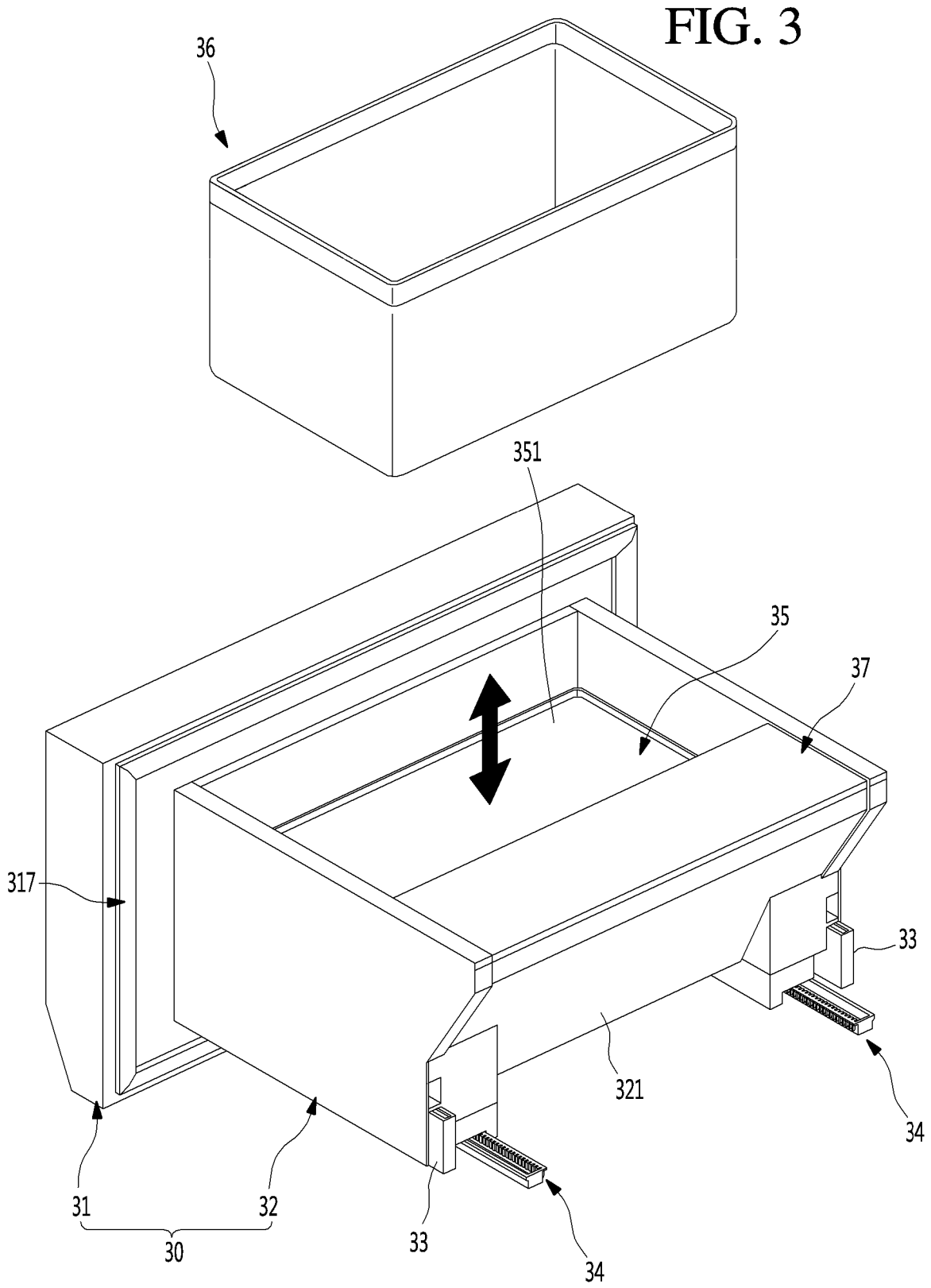
FIG. 3 is a perspective view illustrating a state in which a container of the drawer door is separated.

FIG. 2 is a perspective view of the drawer door according to an embodiment. Also, FIG. 3 is a perspective view illustrating a state in which the container of the drawer door is separated.

As illustrated in the drawings, the drawer door 30 may include a front panel door part 31 opening and closing the storage space and a drawer part 32 coupled to a rear surface of the front panel door part 31 and inserted and withdrawn together with the front panel door part 31.

The front panel door part 31 may be exposed to the outside of the cabinet 10 to define an outer appearance of the refrigerator 1, and the drawer part 32 may be disposed inside the cabinet 10 to define an accommodation space. Also, the front panel door part 31 and the drawer part 32 may be coupled to each other and inserted and withdrawn forward and backward together with each other.

The drawer part 32 may be disposed on the rear surface of the front panel door part 31 to define a space in which the food or container 36 to be stored is accommodated. The inside of the drawer part 32 may have a box shape having an opened top surface to define the accommodation space therein.

The drawer part 32 may be constituted by both left and right surface parts for mounting of the elevation device (see reference numeral 51 of FIG. 7) and a bottom surface part connecting both the left and right surface parts to each other to define a bottom surface and also may selectively include a front surface part and a rear surface part.

An outer appearance of the drawer part 32 may be defined by a plurality of plates 391, 392, and 395. Each of the plurality of plates 391, 392, and 395 may be made of a metal material and provided inside and outside the drawer part 32 so that the entire drawer part 32 is made of stainless steel or a material having a texture such as stainless steel.

In the state in which the drawer door 30 is inserted, a machine room 3 in which a compressor and a condenser constituting a refrigeration cycle are provided may be disposed behind the drawer door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the drawer door 30 may be provided on each of both side surfaces of the drawer part 32. The drawer door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided on the bottom surface of the drawer part 32 and called an under rail. The draw-out rail may be disposed on a lower portion or the bottom surface of the drawer part to prevent the draw-out rail from interfering with the elevation device 51 and secure independent operations of the draw-out rail 33 and the elevation device 51.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the drawer door 30. That is, when an operation is inputted into the manipulation parts 22 and 301, the draw-out motor 14 may be driven to insert and withdraw the drawer door 30 according to movement of the draw-out rack 34. Here, the drawer door 30 may be stably inserted and withdrawn by the draw-out rail 33.

The draw-out rack 34 may not be provided on the drawer part 32. Here, the user may hold a side of the front panel door part 31 to push and pull the front panel door part 31 so that the drawer door 30 is directly inserted and withdrawn.

The inside of the drawer part 32 may be divided into a front space S1 and a rear space S2. The support member 35 that is vertically elevated and a container seated on the support member 35 to be elevated together with the support member 35 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the drawer door 30 is withdrawn, the entire drawer part 32 may not be withdrawn to the outside of the storage space due to a limitation in draw-out distance of the drawer door 30. That is, at least the front space S1 is withdrawn to the outside of the storage space, and the whole or a portion of the rear space S2 is disposed inside the storage space within the cabinet 10, i.e., in the lower storage space.

The draw-out distance of the drawer door may be limited by the draw-out rack 34 or the draw-out rail 33. Also, when compared with a draw-out distance of the general drawer door 30 in which the drawer part 32 is completely withdrawn, the draw-out distance according to this embodiment may be relatively short. Thus, when compared with a case in which the drawer part 32 is completely withdrawn to the outside of the lower storage space, acting moment may be reduced to prevent the draw-out rail 33 or the draw-out rack 34 from being deformed or damaged by a load of the drawer door.

The support member 35 is accommodated in the front space S1. The support member 35 may be elevated together with the food or container 36 seated on the support member 35 inside the drawer part 32. Also, constituents for the elevation of the support member 35 may be disposed on both left and right surfaces of the drawer part 32 and coupled to a central point of both side surfaces of the support member 35 to fix the support member 35 to be elevated without allowing the support member to be lean to one side.

A separate drawer cover 37 may be provided in the rear space S2. The front space S1 and the rear space S2 may be partitioned by the drawer cover 37. In a state in which the drawer cover 37 is mounted, front and top surfaces of the rear space S2 may be covered. Thus, the food or container 36 accommodated in the support member 35 that is elevated in the front space S1 may be prevented from dropping into the rear space.

Particularly, in the elevation process, the food or container 36 seated on the support member 35 may be prevented from being separated from the front space S1.

When the drawer cover 37 is separated, the user may be accessible to the rear space S2, and thus, foods may be easily accommodated in the rear space S2. To utilize the rear space S2, a separate structure for accommodating may be provided in the rear space S2.

Figure 4:
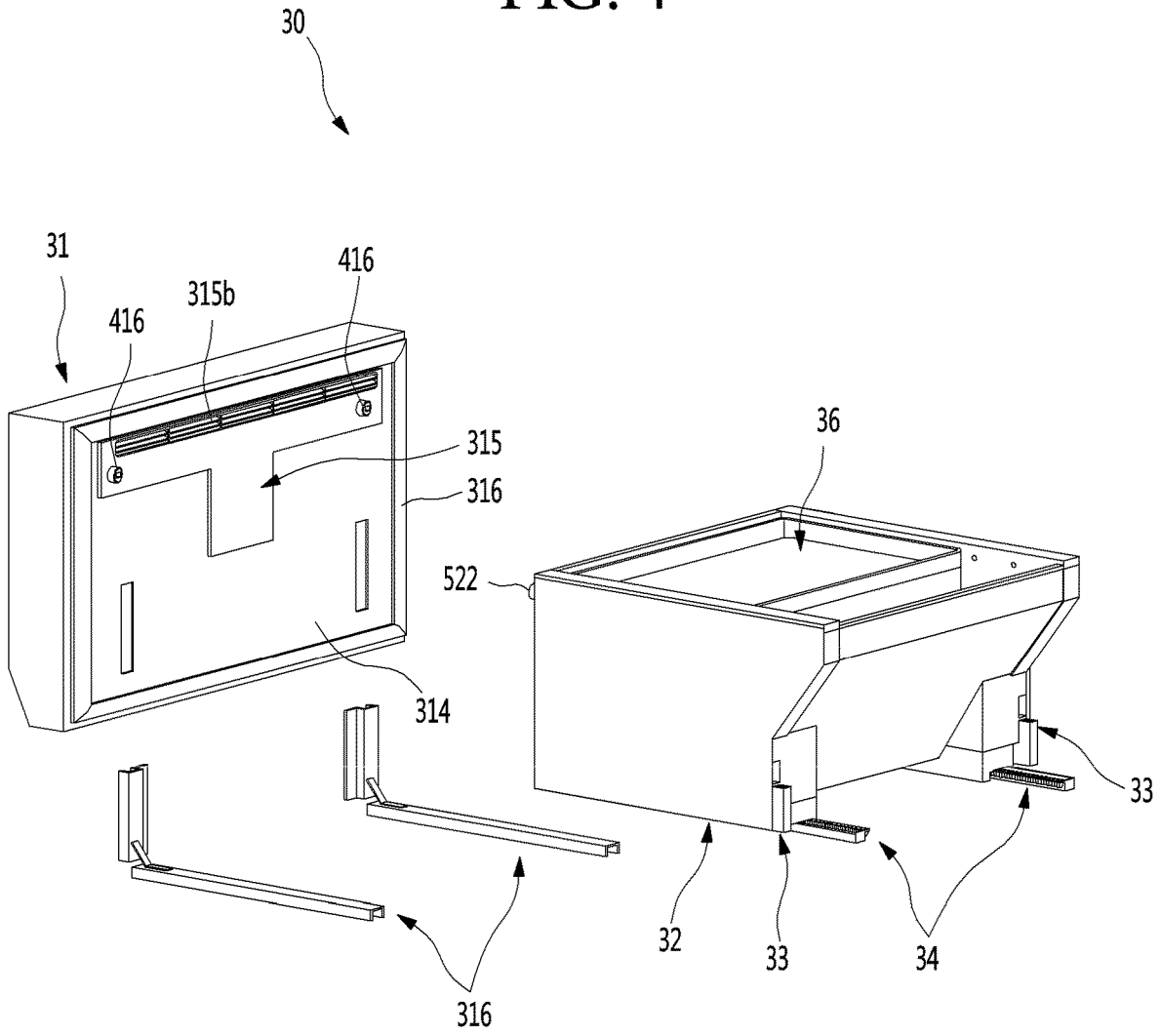
FIG. 4 is an exploded perspective view illustrating a state in which a drawer part of the drawer door and a front panel door part are separated from each other when viewed from a rear side.
Figure 5:
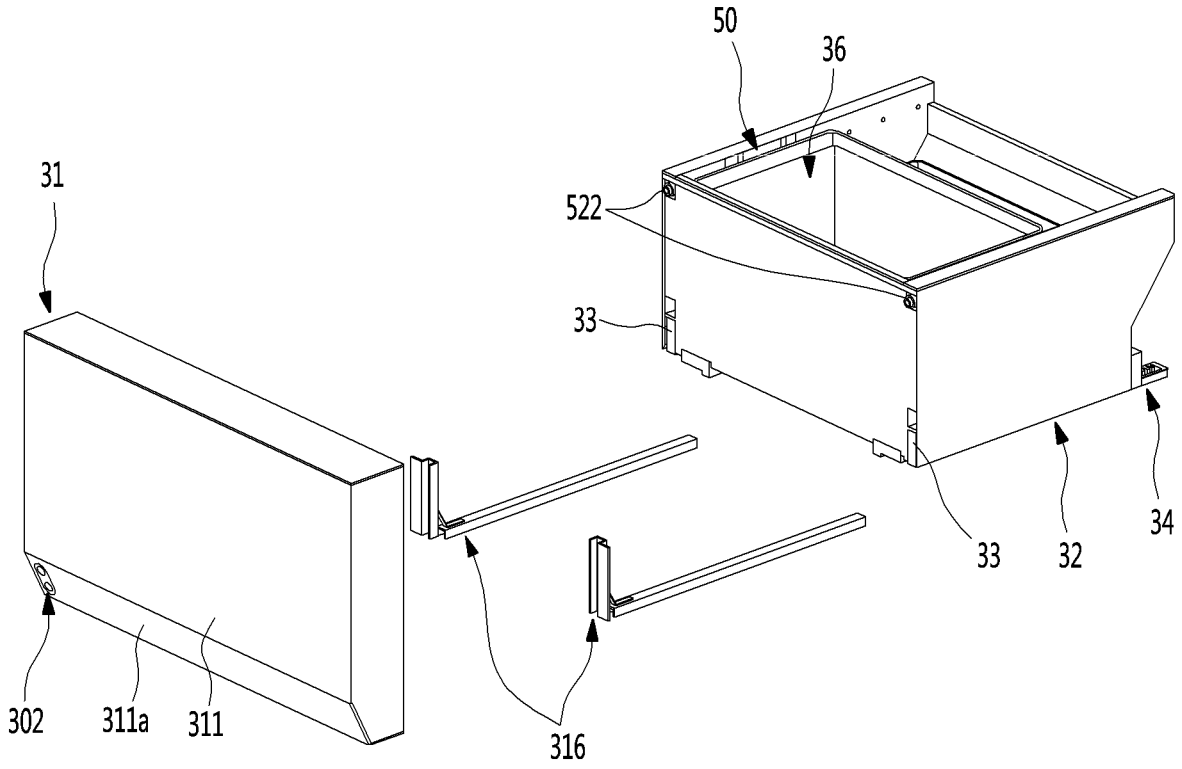
FIG. 5 is an exploded perspective view illustrating a state in which the drawer part of the drawer door and the front panel door part are separated from each other when viewed from a front side.

FIG. 4 is an exploded perspective view illustrating a state in which the drawer part of the drawer door and the front panel door part are separated from each other when viewed from a rear side. FIG. 5 is an exploded perspective view illustrating a state in which the drawer part of the drawer door and the front panel door part are separated from each other when viewed from a front side.

As illustrated in the drawings, the front panel door part 31 and the drawer part 32 constituting the drawer door 30 may be coupled to be separated from each other. Thus, assembling workability and serviceability may be improved through the separable structure of the front panel door part 31 and the drawer part 32.

A rear surface of the front panel door part 31 and a front surface of the drawer part 32 may be coupled to each other. When the front panel door part 31 and the drawer part 32 are coupled to each other, power for the elevation of the support member 35 may be provided. The elevation assembly (see reference numeral 40 of FIG. 12) for the elevation of the support member 35 may be disposed on each of the front panel door part 31 and the drawer part 32. When the front panel door part 31 and the drawer part 32 are coupled to or separated from each other, the elevation assembly may be selectively connected.

For this, the elevation assembly 40 may include a door-side device (see reference numeral 41 of FIG. 6) provided in the front panel door part 31 and a drawer-side device (see reference numeral 50 of FIG. 12) provided in the drawer part 32. The door-side device 41 may be provided in the front panel door part 31, and a door connection member 416 that is one component of the door-side device 41 may be exposed to the rear surface of the front panel door part 31. Also, the drawer-side device 50 may be provided in the drawer part 32, and a drawer connection member 522 disposed at a position corresponding to the door connection member 416 may be exposed to the front surface of the drawer part 32. The door connection member 416 and the drawer connection member 522 may have shapes corresponding to each other and be coupled to be separated from each other. When the door connection member 46 and the drawer connection member 522 are coupled to each other, power may be transmitted. When the front panel door part 31 is fixed to the drawer part 32, the door connection member 416 and the drawer connection member 522 may be coupled to each other. When the front panel door part 31 is separated from the drawer part 32, the door connection member 416 and the drawer connection member 522 may be separated from each other.

That is, a protrusion and a groove may be provided on the door connection member 416 and the drawer connection member 522, respectively. The protrusion and the groove may have a polygonal shape or a shape that is capable of transmitting the power and be interlocked with each other. The door connection member 416 and the drawer connection member 522 may have a different coupling structure in which the power is capable of being transmitted and detachable.

The door cover 315 may be disposed on the rear surface of the front panel door part 31. The door cover 315 may be assembled to be mounted so that the door-side device 41 is covered after the door-side device 41 is mounted behind the front panel door part 31. The door cover 315 may be configured to cover the entire rear surface of the front panel door part 31 or cover only an area corresponding to the door-side device 41.

Also, a pair of door frames 316 may be disposed on the rear surface of the door 2. The coupled state of the front panel door part 31 and the drawer part 32 may be maintained by the door frames 316.

Hereinafter, the front panel door part 31 and the drawer part 32 constituting the drawer door 30 will be described in more detail with reference to the drawings.

Figure 6:
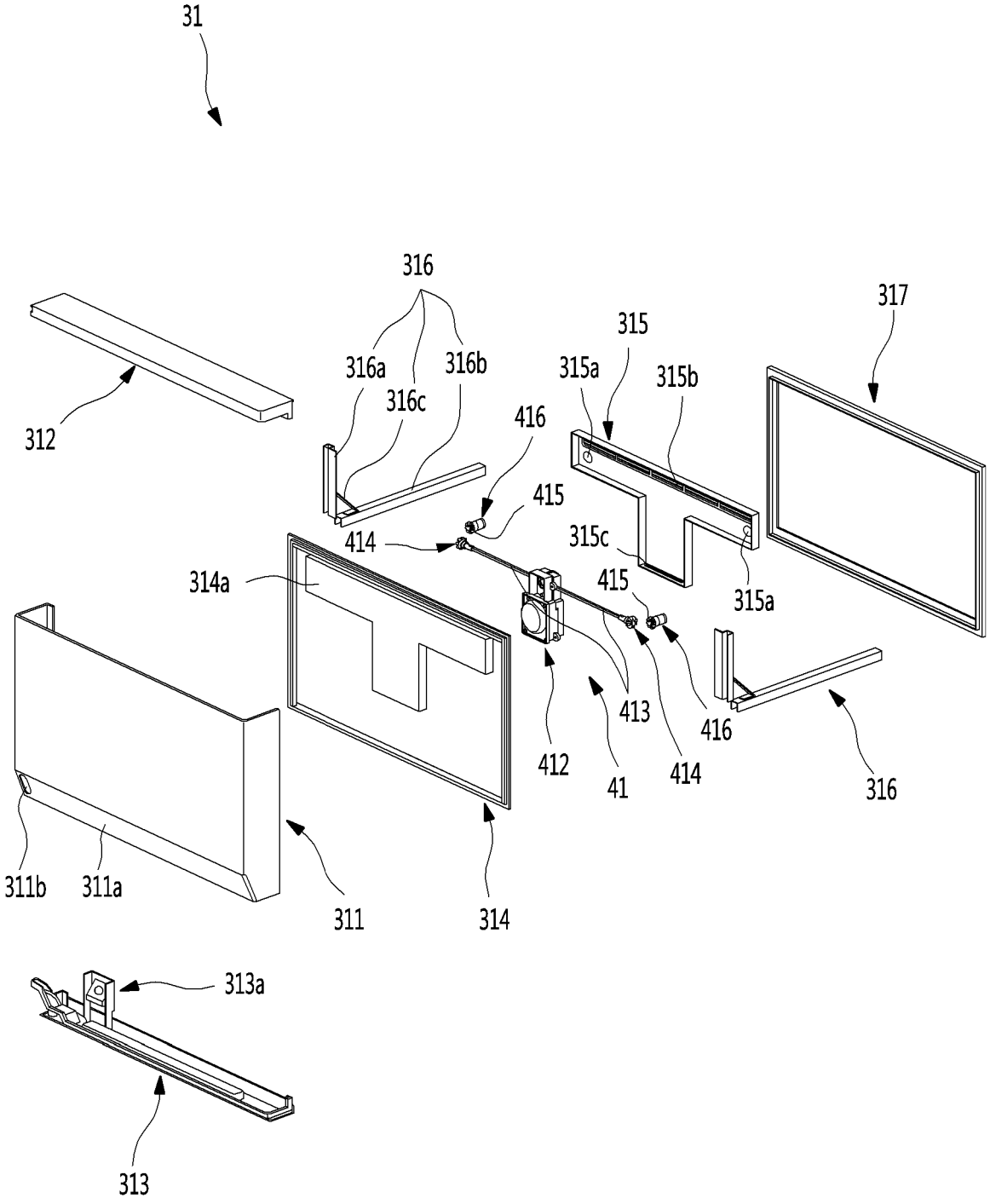
FIG. 6 is an exploded perspective view of the front panel door part.

FIG. 6 is an exploded perspective view of the front panel door part.

As illustrated in the drawings, the front panel door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material may be filled into the front panel door part 31.

The outer case 311 may be formed by bending a plate-shaped metal material, and an inclined part 311*a* may be provided on a lower end of a front surface of the outer case 311. A manipulation device hole 311*b* is defined in one side of the inclined part 311*a*, and the manipulation device 302 for detecting an output of a virtual switch and user's manipulation may be disposed in the manipulation device hole 311*b*. The manipulation device 302 may be constituted by a projector light that outputs an image to be used as a virtual switch and a proximity sensor.

A manipulation part bracket 313*a* for the mounting of the manipulation device 302 and an arrangement of a line connected to electrical components within the front panel door part 31 may be provided in the lower deco 313.

The door liner 314 may be injection-molded by using a plastic material to define the rear surface of the front panel door part 31. Also, the door liner 314 may have a recess part 314*a* in which the door-side device 41 is mounted. The door cover 315 may be mounted on the door liner 314 to cover the door-side device mounted on the front panel door part 31 and the recess part 314*a*.

A cold air inflow hole 315*b* may be defined in an upper portion of the door cover 315. At least a portion of the cold air inflow hole 315*b* may be exposed at a height higher than that of the upper end of the drawer part 32 when the front panel door part 31 and the drawer part 32 are coupled to each other. Thus, a portion of cold air supplied to the drawer part 32 may be introduced into the door cover 315 through the cold air inflow hole 315*b*. Also, a cold air discharge hole 315*c* may be defined in a lower portion of the door cover 315. The cold air discharge hole 315*c* is opened downward between the front panel door part 31 and the drawer part 32. Thus, the cold air introduced into the door cover 315 may flow up to a lower side of the drawer part 32.

That is, the door cover 315 may provide a flow and circulating path of the cold air at the front of the drawer part 32 therein. In a state in which the drawer part 32 is inserted into the storage space of the cabinet 10, the cold air may circulate around the drawer part 32 to more efficiently cool the drawer part 32.

Also, a connection member hole 315*a* may be defined in the rear surface of the front panel door part 31. The connection member hole 315*a* may be defined in the door cover 315. The door connection member 416 may be exposed to the rear surface of the front panel door part 31 through the connection member hole 315*a*. The door connection member 416 may move forward and backward according to the user's manipulation. When the front panel door part 31 and the drawer part 32 are separated from each other by the user's manipulation, the door connection member 416 and the drawer connection member 522 may be separated from each other.

The door-side device 41 may be provided on the front panel door part 31. The door-side device 41 may be constituents disposed on the front panel door part 31 of the elevation assembly and include a motor assembly 412 providing power, a door-side shaft rotating by the motor assembly 412, a door-side first gear 414 having a bevel gear shape and disposed on each of both ends of the door-side shaft 413, and a door-side second gear 415 having a bevel gear shape and coupled to the door-side first gear 414 and the door connection member 416. Also, the door-side device 41 may further include the door connection member 416. A configuration of each of the constituents of the door-side device 41 will be described below in more detail.

The door-side device 41 may include the motor assembly 412 and the door-side shaft 413 passing through the motor assembly 412. The motor assembly 412 may provide power for driving the elevation assembly. Also, the motor assembly 412 may be disposed in parallel to the front surface of the front panel door part 31 to minimize a recessed depth of the inside of the front panel door part 31, thereby securing insulation performance.

The pair of door frames 316 may be disposed on both left and right sides on the rear surface of the front panel door part 31. The door frames 316 may connect the front panel door part 31 to the drawer part 32 so that the drawer part 32 is maintained in the state of being coupled to the front panel door part 31.

In detail, the door frames 316 may be constituted by a door frame part 316*a* fixed to the rear surface of the front panel door part 31 and a drawer frame part 316*b* fixed to the bottom surface of the drawer part 32. The door frame part 316*a* and the drawer frame part 316*b* may be vertically perpendicular to each other. Also, a frame reinforcement part 316*c* connecting the door frame part 316*a* to the drawer frame part 316*b* to prevent the door frames 316 from being deformed may be further provided.

The door frame part 316*a* may be mounted on the rear surface of the front panel door part 31 and provided in the front panel door part 31 so that the drawer frame part 316*b* extends to pass through the rear surface of the front panel door part 31. Also, the drawer frame part 316*b* may extend backward from a lower end of the door frame part 316*a* to support the drawer part 32 at a lower side.

Also, the drawer frame part 316*b* may be fixed and mounted on a lower end of each of both sides of the drawer part 32 on which the draw-out rail 33 is mounted. Here, the draw-out rail 33 may support the drawer part 32 at both the sides together with the drawer frame part 316*b*.

Also, a gasket 317 contacting the front end of the cabinet 10 to seal the storage space may be disposed around the rear surface of the door liner 314.

Figure 7:
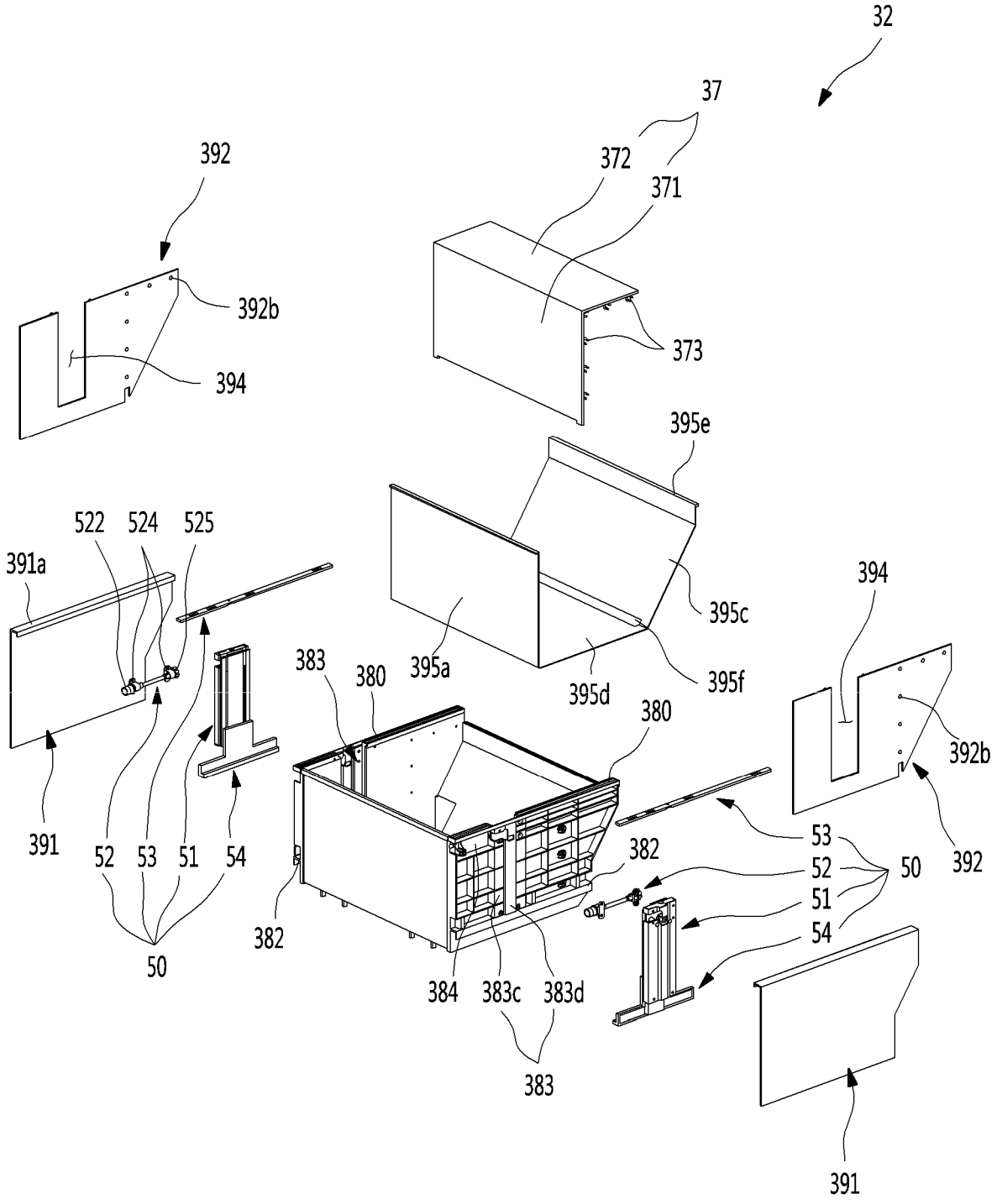
FIG. 7 is an exploded perspective view of the drawer part.
Figure 8:
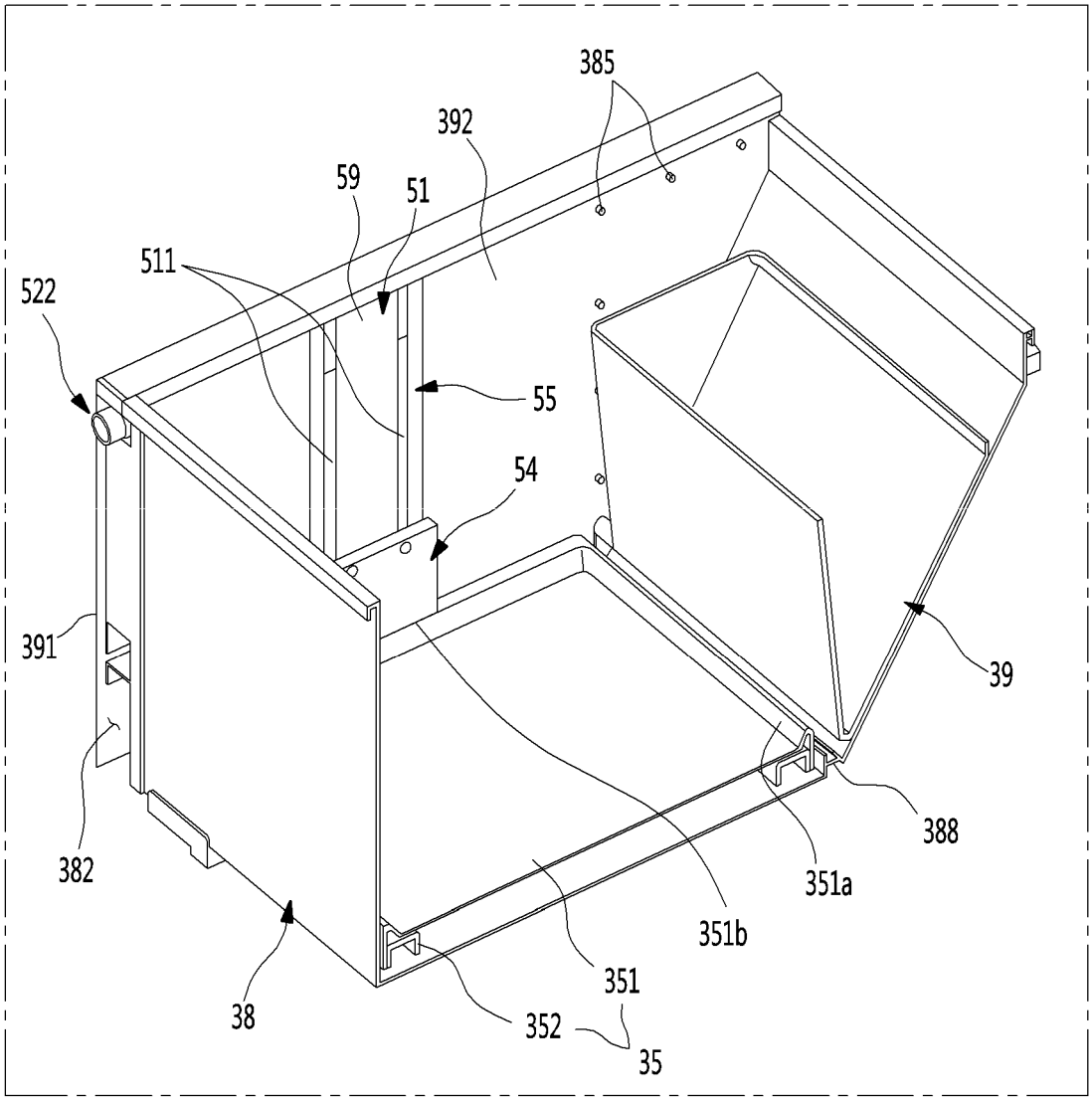
FIG. 8 is a cutaway perspective view illustrating a structure of the drawer part.
Figure 9:
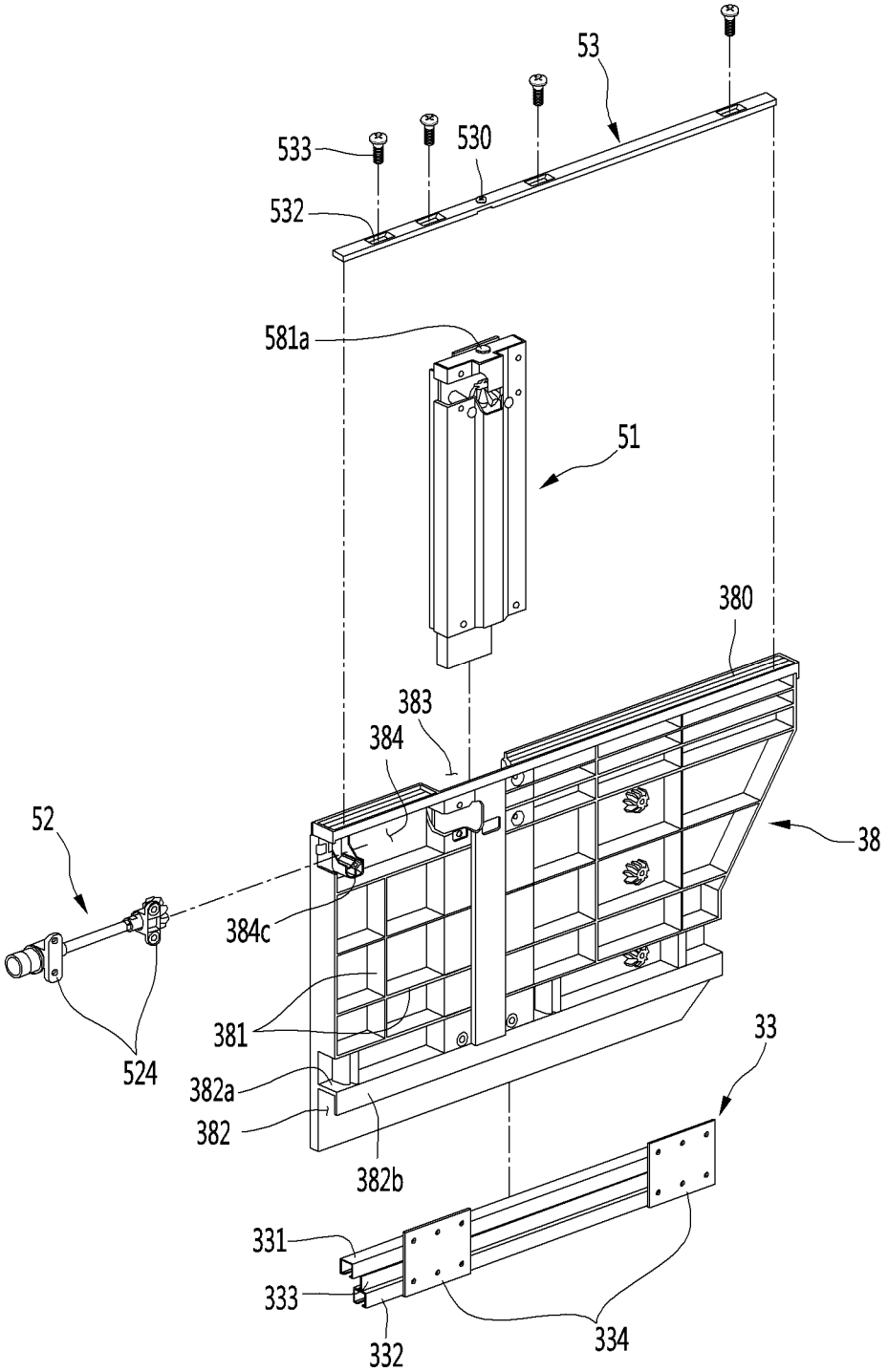
FIG. 9 is a partial perspective view of a sidewall surface of the drawer part.
Figure 10:
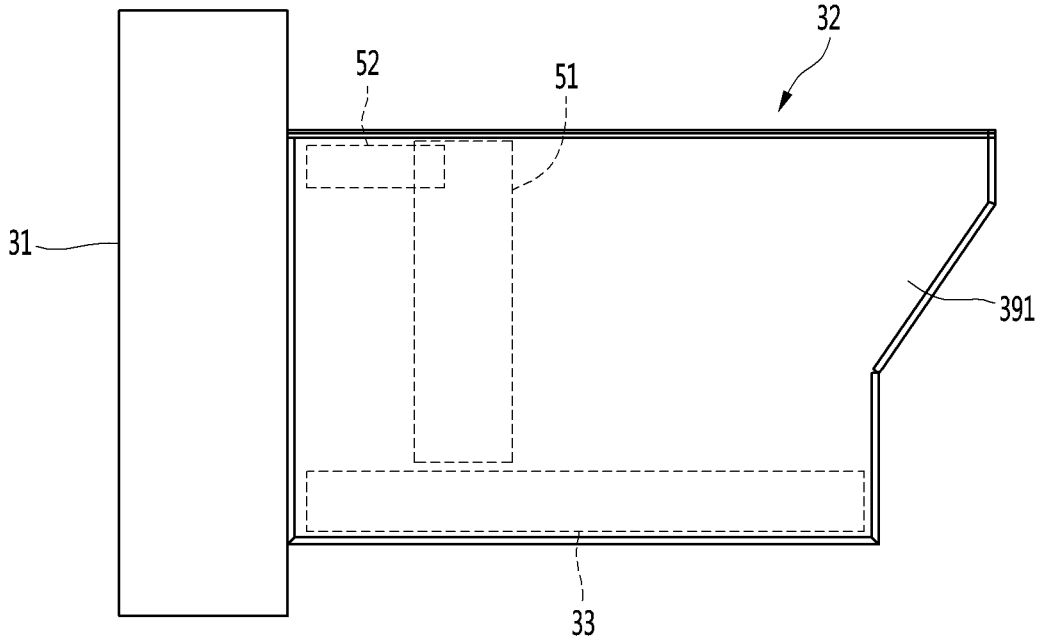
FIG. 10 is a schematic side view illustrating an arrangement of a support member and an elevation device within the drawer part.
Figure 11:
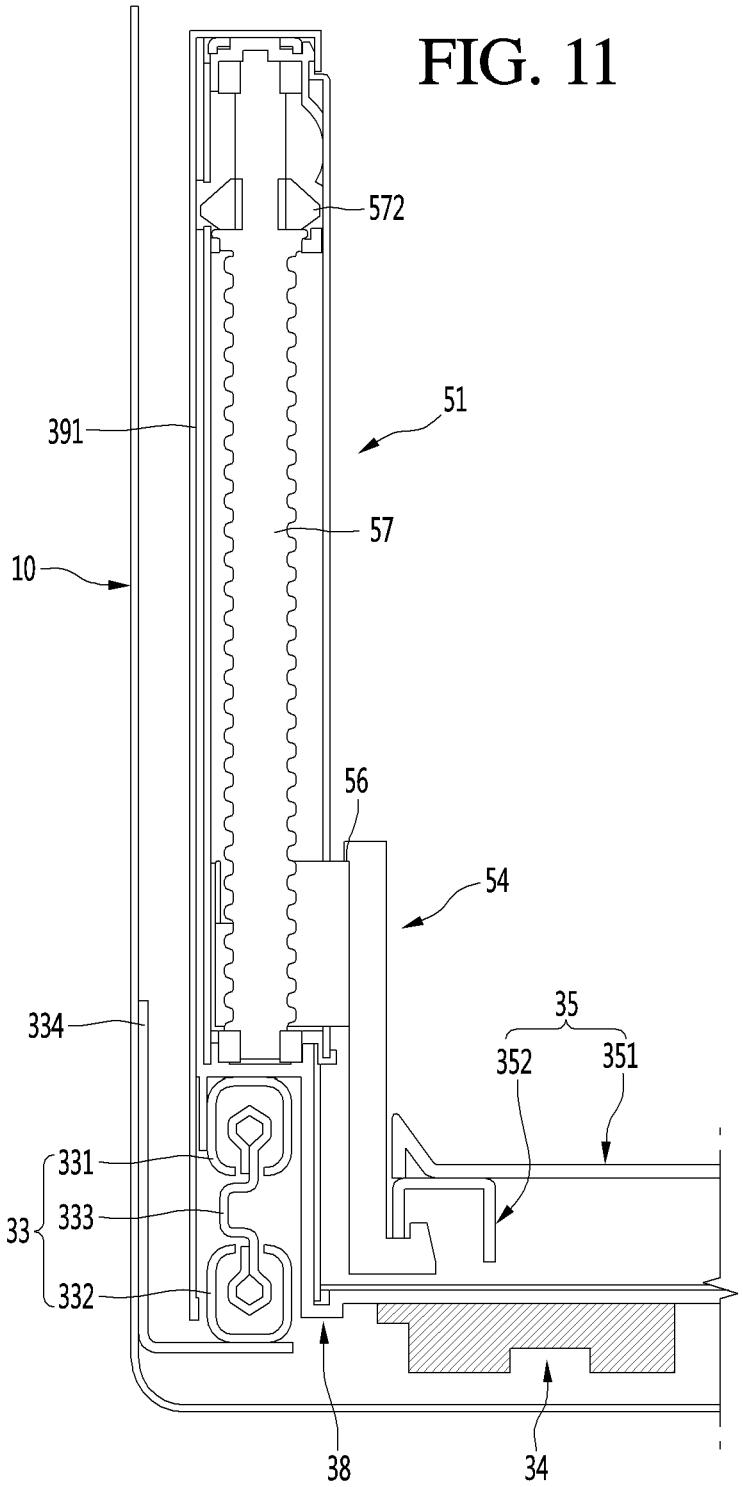
FIG. 11 is a cross-sectional view illustrating an arrangement of the support member, a draw-out rail, and the elevation device in a state in which the drawer part is mounted on a cabinet.

FIG. 7 is an exploded perspective view of the drawer part. Also, FIG. 8 is a cutaway perspective view illustrating a structure of the drawer part. Also, FIG. 9 is a partial perspective view of a sidewall surface of the drawer part. Also, FIG. 10 is a schematic side view illustrating an arrangement of the support member and the elevation device within the drawer part. Also, FIG. 11 is a cross-sectional view illustrating an arrangement of the support member, the draw-out rail, and the elevation device in a state in which the drawer part is mounted on the cabinet.

As illustrated in the drawings, the drawer part 32 may include a drawer body 38 defining an entire shape of the drawer part 32, a drawer-side device 50 provided in the drawer body 38 to constitute the elevation assembly 40, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food accommodation space therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to a lower portion of each of both sides of the bottom surface or both left and right surfaces of the drawer part 32. The drawer part 32 and the front panel door part 31 may be integrally coupled to each other and be inserted and withdrawn together with each other.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion of the rear space S2 is disposed in the lower storage space.

Also, the draw-out rack 34 may be coupled to a pinion gear 141 disposed on the bottom surface of the storage space. Thus, when the draw-out motor (see reference numeral 14 of FIG. 21) is driven, the pinion gear (see reference numeral 141 of FIG. 21) may rotate to allow the draw-out rack 34 to move, and the drawer door 30 may be inserted and withdrawn.

The drawer door 30 may not be automatically inserted and withdrawn. That is, the user may push or pull the drawer door 30 to be inserted and withdrawn. Here, the draw-out rack 34 may be omitted, and thus, the insertion and withdrawal may be performed through only the draw-out rail 33.

A plurality of reinforcement ribs 381 may extend in vertical and horizontal directions on both left and right sides of the drawer body 38. The reinforcement ribs 381 may prevent the drawer body 38 from being deformed by a load applied to both the left and right surfaces of the drawer body.

Particularly, the elevation device 51, which is a main component for the elevation of the support member 35, may be disposed on both side surfaces of the drawer body 38. Thus, when the support member 35 and the food or container seated on the support member 35 is elevated, a load may be concentrated into both the side surfaces of the drawer body 38. The reinforcement ribs 381 may maintain the shape of the drawer body 38, particularly, the drawer part 32 even under the concentrated load.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated.

The rail mounting part 382 may be disposed below the elevation device 51 to prevent the interference with the elevation device 51. Also, the rail mounting part 382 may be disposed on the lower end of both the side surfaces of the drawer body 38 to secure a sufficient elevation distance of the elevation device 51 in the vertical direction.

Also, the rail mounting part 382 may include a top surface part extending outward from the side surface of the drawer body 38 and a side surface part 382*b* extending downward from the extending end of the top surface part 382*a*. Thus, when the rail mounting part 382 is mounted on the draw-out rail 33, the top surface part 382*a* may contact the top surface of the draw-out rail 33, and the side surface part 382*b* may contact an outer surface of the draw-out rail 33. Thus, the draw-out rail 33 may be maintained in the stably mounted state and prevent the draw-out rail 33 and the drawer body 38 from being moving therebetween.

The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the drawer door 30.

In detail, the draw-out rail 33 may include a first fixed rail 331 fixed to the drawer body 38, a second fixed rail 332 fixed to the inside of the cabinet 10 below the first fixed rail 331, and an intermediate rail 333 connected to the first fixed rail 331 and the second fixed rail 332. A bearing may be provided between the intermediate rail 333 and each of the first fixed rail 331 and the second fixed rail 332. Each of the first fixed rail 331, the second fixed rail 332, and the intermediate rail 333 may be rolled.

The draw-out rail 33 may have a structure in which the first fixed rail 331 supports the drawer body 38, and the second fixed rail 332 is fixed to the inner surface of the storage space of the cabinet to allow the drawer part 32 to be withdrawn in multistage. Here, the first fixed rail 331 may have a structure that is hooked with the rail mounting part 382 or be fixed and mounted by a separate coupling member.

The drawer frame part 316*b* of the door frames 316 may be mounted on the rail mounting part 382. The drawer frame part 316*b* may be opened downward and have a cross-sectional shape in which the first fixed rail 331 is accommodated. Thus, the door frames 316 and the draw-out rail 33 may be mounted together on the rail mounting part 382.

A rail bracket 334 may be disposed on the second fixed rail 332. A coupling member such as a screw may be coupled and fixed to the rail bracket 334 on the inner surface of the cabinet 10 to fix the draw-out rail 33 to both sidewall surfaces of the storage space inside the cabinet 10. The rail bracket 334 may be provided in plurality in front and rear directions and disposed on front and rear ends of the second fixed rail 332.

As illustrated in FIG. 11, the draw-out rail 33 may have a structure that supports the drawer body 38 at the lower side. The first fixed rail 331 and the second fixed rail 332 may be disposed in the vertical direction to secure the sufficient draw-out distance, and each of the first fixed rail 331 and the second fixed rail 332 may extend in multistage. Thus, the draw-out rail 33 may be called a under rail.

Particularly, the draw-out rail 33 may have the same structure as the under rail to minimize a width between the cabinet 10 and the drawer part 32. In addition, the draw-out rail 33 may be disposed below the elevation device 51 to minimize a space required for disposing the draw-out rail 33. Also, the drawer-side shaft 52 connected to the elevation device 51 may also be disposed in the front region of the elevation device 51 to minimize a space required for disposing the drawer-side shaft 52.

As a result, the side surface space of the drawer body 38 in which the elevation device 51 is disposed may correspond to the inside of the region in which the drawer flange 380 is provided. Thus, the elevation device 51, the drawer-side shaft 52, and the draw-out rail 33 may be disposed without an additional space loss in the left and right directions of the drawer part 32 to maximally secure the inner space of the drawer part 32 and provide the elevatable structure.

An elevation device mounting part 383 on which the elevation device 51 that is a main component is mounted may be recessed inside both the side surfaces of the drawer body 38. The elevation device mounting part 383 may be recessed outward from the inner surface of the drawer body 38 providing the drawer space.

Here, a recessed depth of the elevation device mounting part 383 may correspond to a height of the reinforcement rib 381 or a height of the side surface part 382*b* defining the rail mounting part 382 to prevent the mounting part from protruding to the outside of the drawer body 38.

Also, the reinforcement rib 381 may have a height equal to or less than the protruding height of the drawer flange 380. Thus, when the outer side plate 391 is mounted, the outer side plate 391 may be supported by the reinforcement rib 381, and a space in which the elevation device, the drawer-side shaft 52, and the draw-out rail 33 are disposed may be secured between the side surface of the drawer body 38 and the outer side plate 391.

The elevation device mounting part 383 may extend in the vertical direction. Here, the elevation device mounting part 383 may vertically extend from the upper end of the drawer body 38 to the bottom surface of the drawer body 38. Here, a lower end of the elevation device mounting part 383 may be disposed above a lower end of each of both the side surfaces of the drawer body 38. The lower end of the elevation device mounting part 383 may extend up to the rail mounting part 382. Thus, the elevation device mounting part 383 may not interfere with the draw-out rail 33 and the constitution for the mounting of the draw-out rail 33.

The elevation device mounting part 383 may extend from the upper end of the drawer body 38 up to the rail mounting part 382. Thus, a maximum draw-out distance may be secured so that the elevation device 51 is mounted without interfering with the draw-out rail 33.

Also, the elevation device 51 may not protrude to the inner space of the drawer part 32 in the state of being mounted on the elevation device mounting part 383.

Also, the inner surface of the elevation device mounting part 383 may have a shape corresponding to that of the outer surface of the elevation device 51. Thus, the elevation device mounting part 383 and the elevation device 51 may be coupled to each other. Here, in the even state in which the load is applied, the stably mounted state of the elevation device 51 may be maintained.

In detail, the elevation device mounting part 383 may include a first elevation device mounting part 383*c* recessed at a central portion and a second elevation device mounting part 383*d* recessed at each of both sides of the first elevation device mounting part 383*c*. Here, the first elevation device mounting part 383*c* may be further recessed than the second elevation device mounting part 383*d* to form a stepped portion between the first elevation device mounting part 383*c* and the second elevation device mounting part 383*d*. Thus, the elevation device 51 having the corresponding shape may be restricted in the mounted state without rotating.

Also, the elevation device 51 may be disposed on the same plane as the inner surface of the drawer body 38 in the state of being mounted on the elevation device mounting part 383 to prevent the interference when the support member 35 is elevated and provide a sense of unity.

A bottom surface of the elevation device mounting part 383 may support the lower end of the elevation device. The bottom surface of the elevation device mounting part 383 may be a top surface part 382*a* of the rail mounting part 382. Thus, a lower end of the elevation device mounting part 383 and the upper end of the may contact each other. Also, the elevation device 51 and the draw-out rail 33 may be mounted on the drawer body 38 in a shape in which the elevation device 51 and the draw-out rail 33 are perpendicular to each other.

Also, the top surface of the elevation device mounting part 383 may be opened so that the elevation device 51 is inserted through the opened upper side. Here, the elevation device 51 may be inserted to be slid from the upper side so that both ends of the elevation device 51 are restricted within the elevation device mounting part 383.

A mounting part bracket 53 may be disposed on the opened top surface of the elevation device mounting part 383. The mounting part bracket 53 may be made of a metal material and restrict the upper end of the elevation device 51.

In detail, the mounting part bracket 53 may be mounted on the upper end of each of both the ends of the drawer body 38 to pass through the opened top surface of the elevation device mounting part 383. Here, a bracket hole 530 into which a cap protrusion (see reference numeral 581*a* of FIG. 14) is inserted may be defined in the top surface of the elevation device 51 in one side of the mounting part bracket 53 corresponding to the opened top surface of the elevation device mounting part 383. Also, the mounting part bracket 53 may extend from the front end to rear end of each of both the side surfaces of the drawer body 38, and a plurality of fixing members 533 may pass through the bracket hole 532 of the mounting part bracket 53 and then be coupled to firmly fix the drawer body 38. Thus, the elevation device may be maintained in the state of being more stably and firmly mounted on the drawer body 38.

The elevation device 51 may be connected to both ends of the support member 35 by the connecting bracket 54. Also, the elevation device 51 may operate to allow the support member 35 to vertically move and guide smooth vertical movement of the support member 35.

The shaft mounting part 384 may be opened outward from the upper end of each of both the side surfaces of the drawer body 38 to communicate with the elevation device mounting part 383. Thus, the drawer-side shaft 52 mounted on the shaft mounting part 384 may be coupled to the elevation device 51 mounted on the elevation device mounting part 383 to transmit the power.

The shaft elevation device mounting part 383 may be disposed on the upper end of each of both the side surfaces of the drawer body 38. The shaft elevation device mounting part 383 may have a top surface defined by the drawer flange 380, a bottom surface defined by the reinforcement rib 381, and a rear surface defined by the sidewall surface of the elevation device mounting part 383.

Also, the drawer elevation device mounting part 383 may extend from the front end of the side surface of the drawer body 38 to one side of the elevation device mounting part 383, and an opening through which the drawer elevation device mounting part 383 and the elevation device mounting part 383 communicate with each other may be defined in the rear surface of the drawer elevation device mounting part 383 and the front surface of the elevation device mounting part 383.

The drawer-side shaft 52 may be mounted inside the drawer elevation device mounting part 383. For this, a shaft of the drawer-side shaft 52 may pass through the drawer-side shaft 52, and the shaft fixing member 524 rotatably supporting the shaft may be disposed on the drawer-side shaft 52. Also, a mounting part 384*c* for fixing and mounting the shaft fixing member 524 may be disposed inside the elevation device mounting part 383. The shaft fixing member 524 may be provided in a pair, which are spaced apart from each other. The shaft fixing member 524 may be fixed and mounted on the mounting part 384*c* disposed at a front side thereof, and a structure corresponding to the mounting part may be disposed on one side of the elevation device mounting part 383.

The elevation device mounting part 383 may have a shape that is recessed from the inner surface of the drawer body 38, and the shaft mounting part 384 may have a shape that is recessed from the outer surface of the drawer body 38. Thus, when the drawer body 38 is molded, a mold may have a simple structure so that the drawer body 38 is easily molded.

All of the elevation device mounting part 383, the shaft mounting part 384, and the rail mounting part 382 may be disposed below the drawer flange 380 that is bent outward from the upper end of both the side surfaces of the drawer body 38 and also disposed inside a lower region corresponding to the left and right width of the drawer flange 380. That is, the elevation device mounting part 383 and the shaft mounting part 384 may be disposed below the outwardly bent region of the drawer flange 380 without protruding inward or outward from the drawer body 38. As described above, the lower region of the drawer flange 380, in which the drawer shaft 52, the elevation device 51, and the draw-out rail 33 are disposed, may be called a disposition space.

Also, in addition to the elevation device mounting part 383, the shaft mounting part 384, and the rail mounting part 382, the elevation device 51, the drawer-side shaft 52, and the draw-out rail 33, which are mounted on the elevation device mounting part 383, the shaft mounting part 384, and the rail mounting part 382, may not also protrude inward or outward from the drawer flange 380.

Thus, all of the drawer-side device 50 and the draw-out rail 330, which constitute portions of the elevation assembly 40, and the structures for mounting the drawer-side device 50 may be disposed within the region of the drawer flange 380, and thus, the loss in accommodation space within the drawer body 38 may not occur.

The support member 35 of the drawer-side device 50 and the elevation device 51 may be disposed on the inner surface of the drawer body 38, and the drawer-side shaft may be disposed outside the drawer body 38. Also, the elevation device mounting part 383 and the shaft mounting part 384 may communicate with each other, and the shaft 52 and the elevation device 51 may be connected to each other in the state of being mounted on the drawer body 38.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, as illustrated in FIG. 10, the constituents such as the drawer-side shaft 52 and the draw-out rail 33, which are mounted on both the sides of the drawer body 38 may not be exposed to the outside.

The outer side plate 391 may define an outer appearance of each of both the left and right surfaces of the outside of the drawer body 38. Also, the outer side plate 391 may be supported by the reinforcement rib 381. The shaft elevation device mounting part 383, the drawer-side shaft 52, the elevation device mounting part 383, the rail mounting part 382, and the draw-out rail 33 may be disposed in a space between the drawer body 38 and the outer side plate 391. Here, the disposition space may be defined between the drawer body 38 and the outer side plate 391, and the disposition space may correspond to a width of the drawer flange 380.

Also, an upper bent part 391*a* may be disposed on an upper end of the outer side plate 391. The upper bent part 391*a* may cover the upper end of each of both the side surfaces of the drawer body 38, i.e., the drawer flange 380.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

An extending end of the upper bent part 391*a* may contact the upper end of the inner side plate 392. Thus, all of the inside and outside and the top surface of both the left and right surfaces of the drawer body 38 may be covered by the inner side plate 392 and the outer side plate 391.

Also, a side opening 394 having a size corresponding to the elevation device mounting part 383 may be defined in the inner side plate 392. Thus, in the state in which the inner side plate is mounted, the elevation device 51 mounted on the elevation device mounting part 383 may be exposed to the inside of the drawer body 38, and since the connecting bracket 54 is mounted, the elevation device 51 may be coupled to the support member 35.

An inner plate 395 may be disposed on each of front, bottom, and rear surfaces of the inside of the drawer body 38. The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the inner surface of the drawer part 32 may more easily transfer heat by the inner side plate 392 and the inner plate 395, and thus, the entire drawer part 32 may be uniformly cooled by the surrounding cold air. Thus, the foods accommodated in the drawer part 32 may be more uniformly cooled and thus stored at a low temperature in the more uniform region. In addition, visually excellent cooling performance and storage performance may be provided to the user.

Also, upper bent parts 395*d* and 395*e* that are bent outward may be further disposed on the front surface part 395*a* and the rear surface part 395*c* of the inner plate 395 to cover the top surfaces of the front end and the rear end of the drawer body 38, respectively. Also, the rear surface part 395*c* may have a shape corresponding to the inclined surface 321 of the rear surface of the drawer body 38 and thus be closely attached to the inclined surface 321.

Also, a bottom surface opening 395*f* may be further defined in the rear end of the bottom surface part 395*b* adjacent to the lower end of the rear surface part 395*c*. The bottom surface opening 395*f* may be opened at a position corresponding to a cover support part 388 protruding from the bottom surface of the drawer body. Thus, the cover support part 388 may be exposed through the bottom surface opening 395*f*. The lower end of the drawer cover 37 may be coupled to the cover support part 388 so that the drawer cover 37 is mounted.

The drawer cover 37 may include a cover front part 371 that partitions the inside of the drawer body 38 into a front space S1 and a rear space S2 and a cover top surface part 372 bent from an upper end of the cover front part 371 to cover a top surface of the rear space S2.

That is, when the drawer cover 37 is mounted, only the front space S1, in which the support member 35 is disposed, may be exposed in the drawer body 38, and the rear space S2 may be covered by the drawer cover 37.

A lower end of the cover front part 371 may be coupled to the cover support part 388. Also, a plurality of cover restriction parts 373 may be disposed along both the left and right ends of the drawer cover 37. The cover restriction part 373 may be disposed at a position corresponding to a plurality of cover restriction protrusions 385 protruding inward from the inner surface of the drawer body 38. Each of the cover restriction protrusions 385 may pass through a protrusion hole 392*b* defined in the inner side plate 392 to protrude.

Also, the cover restriction part 373 may be press-fitted into the cover restriction protrusion 385. When the drawer cover 37 is mounted, the cover restriction protrusion 385 may be coupled to the cover restriction part 373 to fix the drawer cover 37.

A separate rear accommodation member 39 may be further provided in the drawer cover 37. The rear accommodation member 39 may correspond to a shape of the rear space S2 and have an opened top surface.

In detail, the rear accommodation member 39 may have a shape that is gradually narrowed downward. Also, the rear accommodation member 39 may have a front surface vertically contacting the drawer cover 37 and a rear surface inclinedly contacting the inclined surface 321 of the drawer body 38. Also, both left and right surfaces of the rear accommodation member 39 may contact both the left and right surfaces of the drawer body 38, and a lower end of each of both the left and right surfaces of the rear accommodation member 39 may be axially coupled to the drawer body 38 to rotate. Thus, in a state in which the drawer cover 37 is separated, the rear space S2 may be used to accommodate the food. Also, in the even state in which the drawer door 30 is not completely withdrawn forward, the access to the rear accommodation member 39 may be easy by rotating or tilting of the rear accommodation member 39.

The support member 35 may be disposed in the drawer body 38. The support member 35 may include one component of the elevation assembly 40. The support member 35 may have a size that is enough to be accommodated in the front space S1 of the bottom surface of the drawer body 38.

Also, the support member 35 may have a rectangular plate shape. Substantially, the support member 35 may include an elevation plate 351 supporting the food or container and an elevation frame 352 supporting the elevation plate 351 at a lower side and reinforcing strength of the elevation plate 351. The support member 35 may be a portion on which the food or container 36 is substantially seated and supported and thus may be called a seating member or a tray. Also, as necessary, the support member 35 may be provided as one of the elevation plate 351 or the elevation frame 352.

The elevation plate 351 may have a rectangular plate shape and include a circumferential part 351*a* protruding upward along a circumference thereof. The circumferential part 351*a* may have an opened bottom surface, and a portion of the elevation frame 352 may be accommodated in the circumferential part 351*a*. Also, the circumferential part 351*a* may contact a circumference of a bottom surface of the container 36 to prevent the container 36 from moving.

Also, a connecting bracket mounting part 351*b* on which the connecting bracket 54 is mounted may be disposed on each of both left and right surfaces of the circumferential part 351*a*. Also, the connecting bracket mounting part 351*b* may be cut so that the side surface of the elevation frame 352 is exposed. The connecting bracket 54 may mounted on each of both side surfaces of the elevation frame 352 through the connecting bracket mounting part 351*b*.

The connecting bracket 54 may have one side fixed to the elevation frame 352 and the other side coupled to the elevation device 51. Thus, when the elevation device 51 operates, the elevation frame 352 connected to the connecting bracket 54, i.e., the support member 35 may vertically move together with the connecting bracket 54.

The drawer-side device 50 extending in a direction that perpendicularly crosses the draw-out direction of the drawer part 32 may be mounted on the drawer body 38. The drawer-side device 50 may be disposed on the support member 35 and both the sides of the support member 35 and may transmit the power for vertically moving the support member 35 and guide the vertical movement of the support member 35.

The drawer-side device 50 may include the elevation device 51 mounted inside the elevation device mounting part 383 and may further include at least one of the connecting bracket 54, the drawer-side shaft 52, and the mounting part bracket 53 restricting the elevation device 51.

Hereinafter, a structure of the elevation assembly will be described in more detail with reference to the accompanying drawings.

Figure 12:
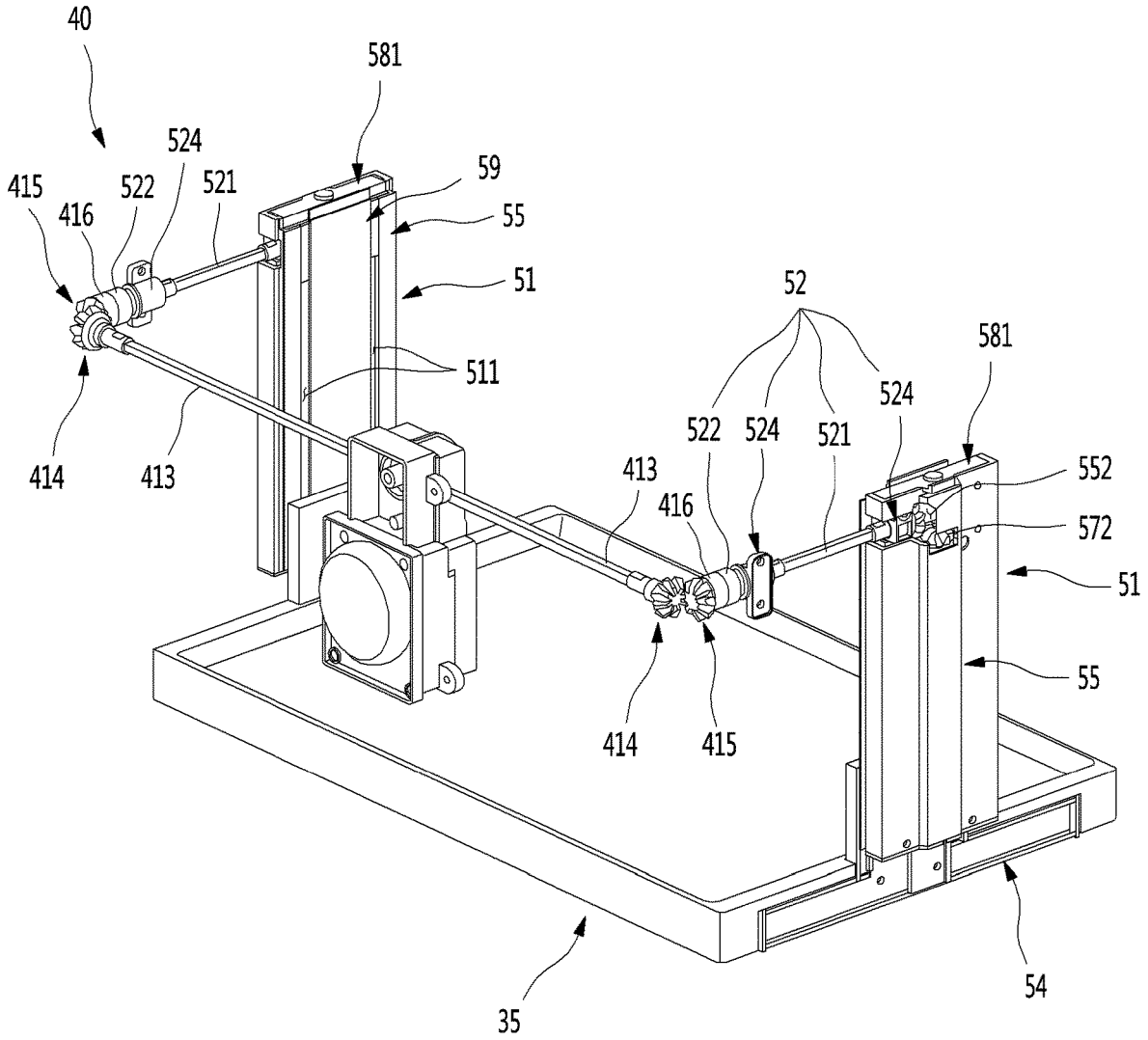
FIG. 12 is a perspective view of an elevation assembly built in the drawer door.

FIG. 12 is a perspective view of the elevation assembly built in the drawer door.

As illustrated in the drawing, the elevation assembly 40 may be constituted by the door-side device disposed in the front panel door part 31 and the drawer-side device 50 disposed in the drawer part 32. Also, the door-side device 41 and the drawer-side device 50 may be coupled to each other by coupling the front panel door part 31 to the drawer part 32 to transmit the power.

As described above, the door-side device 41 may include the motor assembly 412 including the elevation motor 411, the door-side shaft 413 coupled to the motor assembly 412 to rotate, the door-side first gear 414 disposed on each of both the ends of the door-side shaft 413, the door-side second gear 415 engaged with the door-side first gear 414, and the door connection member 416 coupled to the door-side second gear 415.

Although one motor assembly 412 is provided in FIG. 12, if larger torque is required for the elevation of the support member 35, a plurality of motor assembly 412 may be provided. Also, the motor assembly 412 may be disposed in parallel to the front surface of the front panel door part 31 to minimize an insulation space loss of the front panel door part 31.

Although one or two motor assembles 412 are provided, the door-side first gear 414 and the door-side second gear 415, which are disposed on both sides, may rotate by the same rotation rate at the same time. That is, since the pair of elevation devices 51 are driven by rotation force transmitted to the pair of door-side second gears 415, the door-side first gear 414 and the door-side second gear 415 may rotate at the same rotation rate and at the same time to prevent the support member 35 from being tilted. For this, the door-side shaft 413 may have a structure in which one shaft or a plurality of shafts passing through the motor assembly 412 rotates together with each other.

The drawer-side device 50 may include the support member 35 provided inside the drawer body 38, the elevation device 51 and the connecting bracket 54, which disposed on both the sides of the support member 35 to elevate the support member 35, and the drawer-side shaft 52 disposed outside the drawer body 38 to transmit the rotation force of the door-side device 41 to the elevation device 51.

When the motor assembly 412 is driven, the rotation force of the door-side shaft 413 may be transmitted to the drawer-side device 50 by the door connection member 416 and the drawer connection member 522, which are coupled to each other. When the drawer-side shaft 52 rotates by the rotation of the drawer connection member 522, the elevation shaft 57 inside the elevation device 51 coupled to the drawer-side shaft 52 rotates. Since the elevation shaft 57 rotates, an elevation block 567 coupled to the elevation shaft 57 and a block holder 56 coupled to the elevation block 567 may move vertically. The elevation block 567 and the block holder 56 may be integrated to form one body and thus may be called an elevation holder.

The block holder 56 may be coupled to the connecting bracket 54 to elevate the connecting bracket 5, and the connecting bracket 54 disposed each of both the left and right sides may elevate the support member 35 in the state of being coupled to the elevation frame 352.

That is, the rotation force of the motor assembly 412 may be transmitted to the drawer-side shaft 52 through the door-side shaft 413 to allow the elevation shaft 57 to rotate. The block holder 56 and the connecting bracket 54 may guide the support member 35 to move vertically.

Hereinafter, a detailed structure of each of the constituents of the drawer-side device 50 will now be described in more detail with reference to the accompanying drawings.

Figure 13:
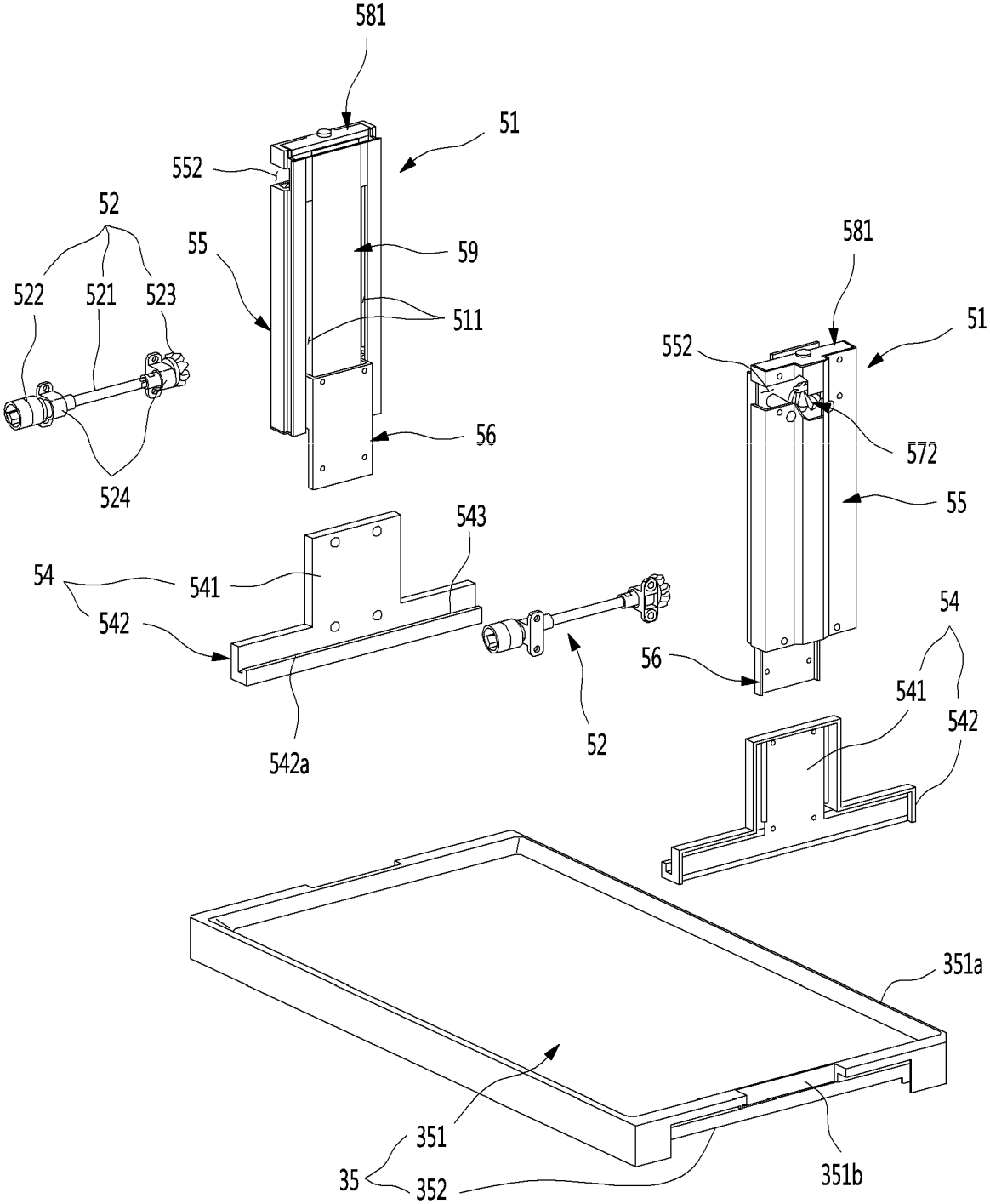
FIG. 13 is an exploded perspective view illustrating a coupling structure of a drawer-side device of the elevation assembly.

FIG. 13 is an exploded perspective view illustrating a coupling structure of the drawer-side device of the elevation assembly.

As illustrated in the drawing, the drawer-side device may include the elevation device 51 for the vertical movement of the support member 35, the drawer-side shaft 52 connected to the elevation device 51 and the door-side device 41 to transmit the power, and the connecting bracket 54 connected to the elevation device 51 and the support member 35.

The arranged position of the elevation device 51 may be a position corresponding to a center of the front space S1 in the front and rear direction and be disposed at a position corresponding to a central portion of each of both the side surfaces of the support member 35. Thus, the support member 35 may be stably elevated without being tilted.

The elevation device 51 may include the housing 55 mounted on the elevation device mounting part 383 to define the inner space, the upper and lower caps 581 and 585 covering the upper and lower ends of the housing 55, the elevation block 567 and the block holder 56, which move along the elevation shaft 57 within the housing 55, and the rail cover 59 covering the opened one surface of the housing 55.

The housing 55 and the rail cover 59 may include a pair of guide slits 511 extending in the vertical direction. The elevation block 567 and the block holder 56 may be elevated along the pair of guide slits 511.

Also, a central portion 553 protruding outward and a side portion 554 extending to be stepped laterally from the central portion 553 may be provided on the outer surface of the housing 55. The central portion 553 and the side portion 554 may have shapes corresponding to the first elevation device mounting part 383*c* and the second elevation device mounting part 383*d* of the elevation device mounting part 383 so that the housing 55 is closely attached and fixed to the inside of the elevation device mounting part 383.

Also, a shaft insertion hole 552 into which an end of the drawer-side shaft 52 extending to the elevation device 51 is accommodated may be defined in the upper end of the housing 55. The shaft insertion hole 552 may be opened in a shape corresponding so that the end of the drawer shaft 521 and the drawer-side gear 523 are inserted, i.e., may be opened to be exposed up to a portion of the elevation shaft 57 coupled to the upper end of the elevation shaft 57. Thus, the mounting and separation of the drawer-side elevation device mounting part 383 may be performed through the shaft insertion hole 552, and also, the coupled state of the drawer-side gear 523 and the shaft gear 572 may be confirmed through the shaft insertion hole 552. In addition, the shaft insertion hole 552 may prevent the operations of the drawer-side gear 523 and the shaft gear 572 from interfering with the housing 55.

The drawer-side shaft 52 may include a drawer shaft 521 having a predetermined length, a drawer connection member 522 disposed on a front end of the drawer shaft 521, and a drawer-side gear 523 disposed on a rear end of the drawer shaft 521. The drawer connection member 522 may be coupled to the door connection member 416 when the front panel door part 31 and the drawer part 32 are coupled to each other, and the drawer-side gear 523 may be coupled to the shaft gear 572. Also, the drawer-side shaft 52 may be fixed and mounted on the drawer body 38 by the pair of shaft fixing members 524.

The connecting bracket 54 may include a rail coupling part 541 coupled to the elevation device 51 and a support member coupling part 542 coupled to the support member 35.

The rail coupling part 541 may define an upper portion of the connecting bracket 54 and be coupled to the block holder 56, which is exposed to the outside, of the elevation device 51. The rail coupling part 541 and the block holder 56 may be firmly coupled to each other by a coupling member such as a screw.

The support member coupling part 542 may be disposed on a lower end of the rail coupling part 541 and coupled to each of both side ends of the support member 35. The support member coupling part 542 may have a length greater than a horizontal width of the rail coupling part 541 to stably support both the ends of the support member 35.

The support member coupling part 542 may be bent several times to define a coupling groove 842*a* that is opened upward, and both the ends of the support member 35 may be seated on the coupling groove 842*a*. In detail, the elevation frame 352 may be inserted into the coupling groove 842*a*. The rail coupling part 541 may be inserted into the connecting bracket mounting part 351*b* to couple the support member 35 to the connecting bracket 54 without moving.

The support member 35 may have a structure that is seated downward from an upper side of the coupling groove 542*a*. Here, the support member 35 may be seated on the connecting bracket 54 without using a separate coupling member. That is, the firm and stable coupling structure may be provided in the drawer body 38. Thus, when a service of the elevation device 51 is required, the elevation device 51 may be easily separated. Also, when the elevation function is not used, the support member 35 may be easily separated.

Hereinafter, the configuration of the elevation device will be described in detail with reference to the accompanying drawings.

Figure 14:
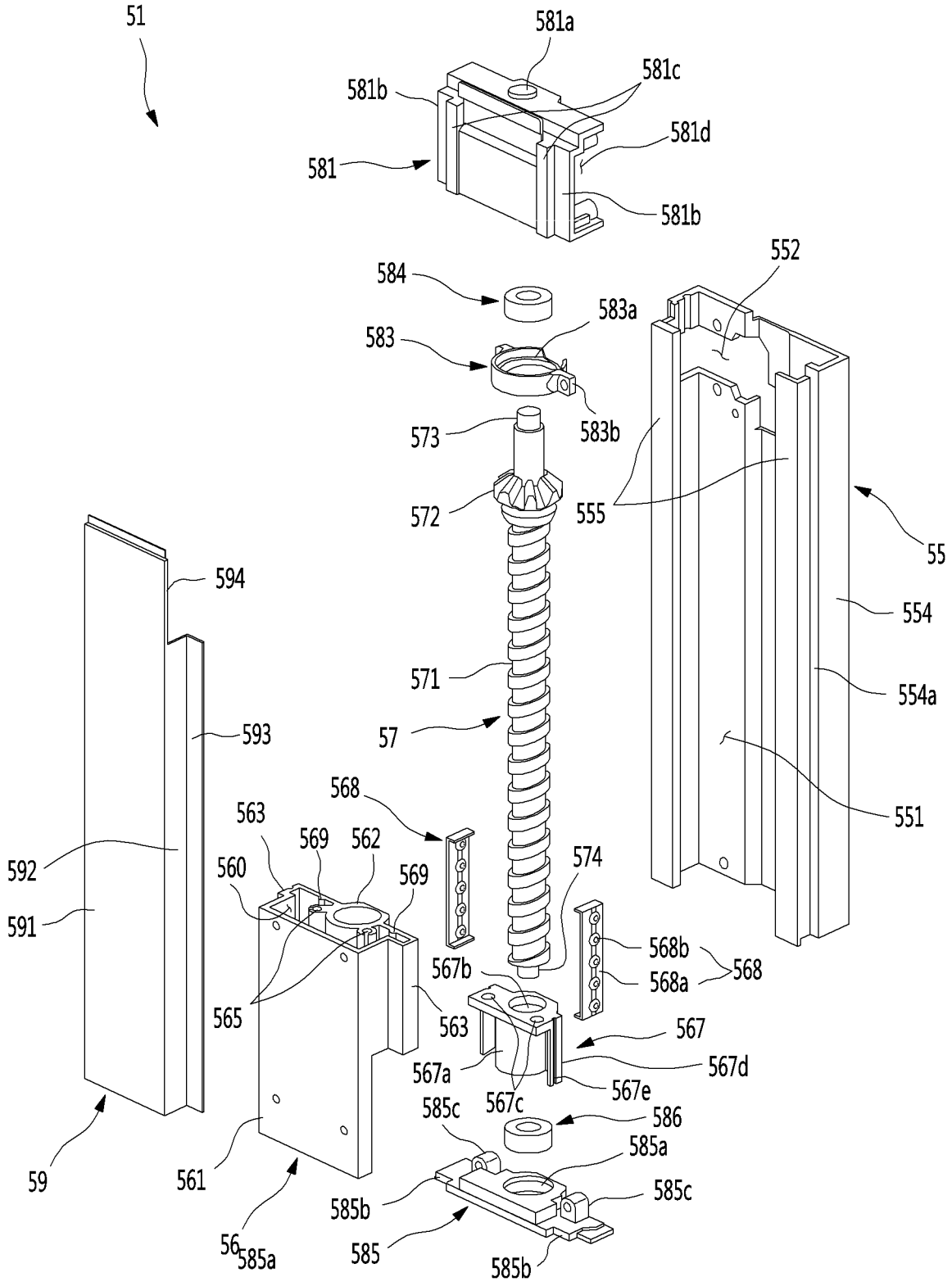
FIG. 14 is an exploded perspective view illustrating a structure of the elevation device when viewed in one direction.
Figure 15:
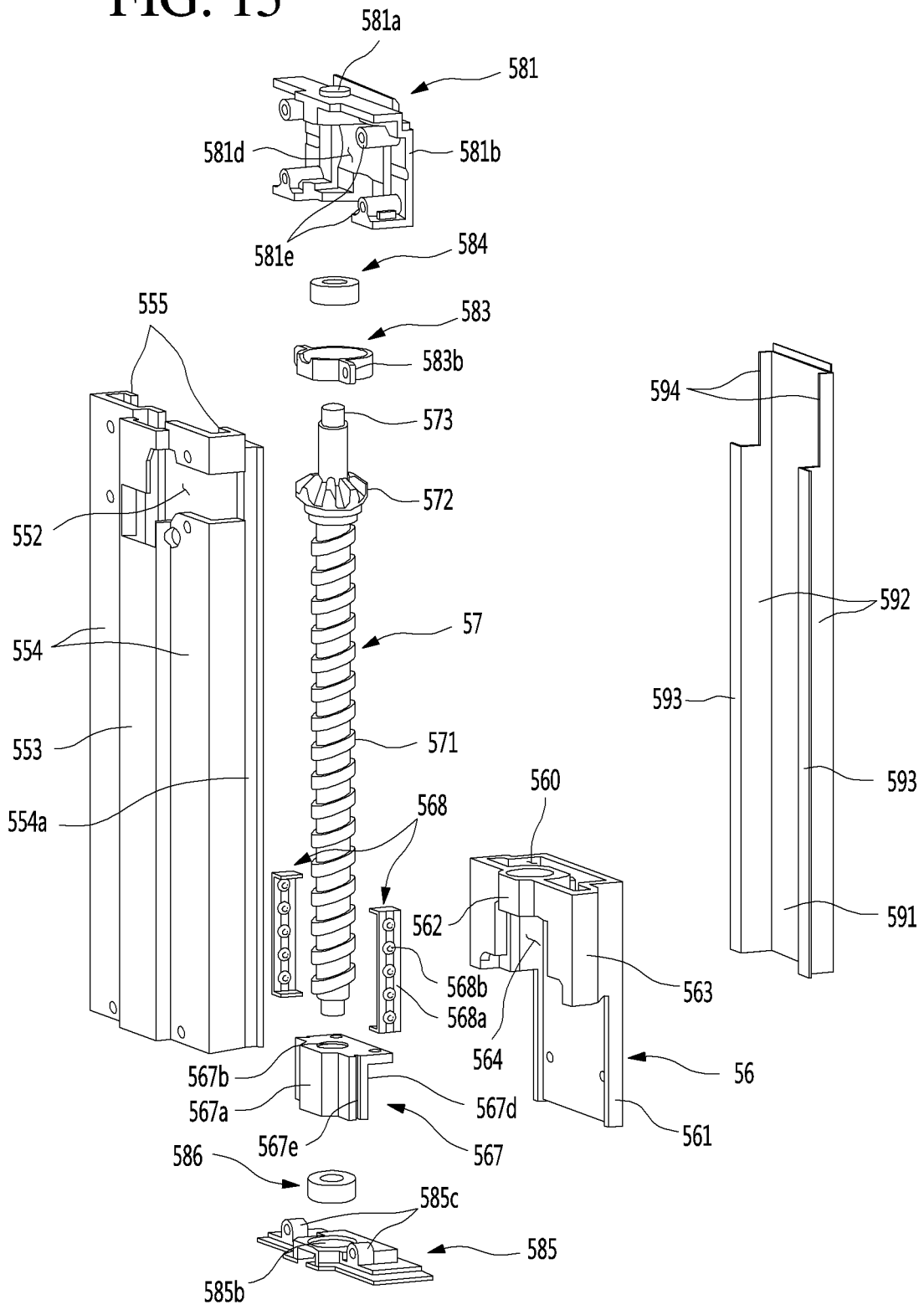
FIG. 15 is an exploded perspective view illustrating the structure of the elevation device when viewed in the other direction.
Figure 16:
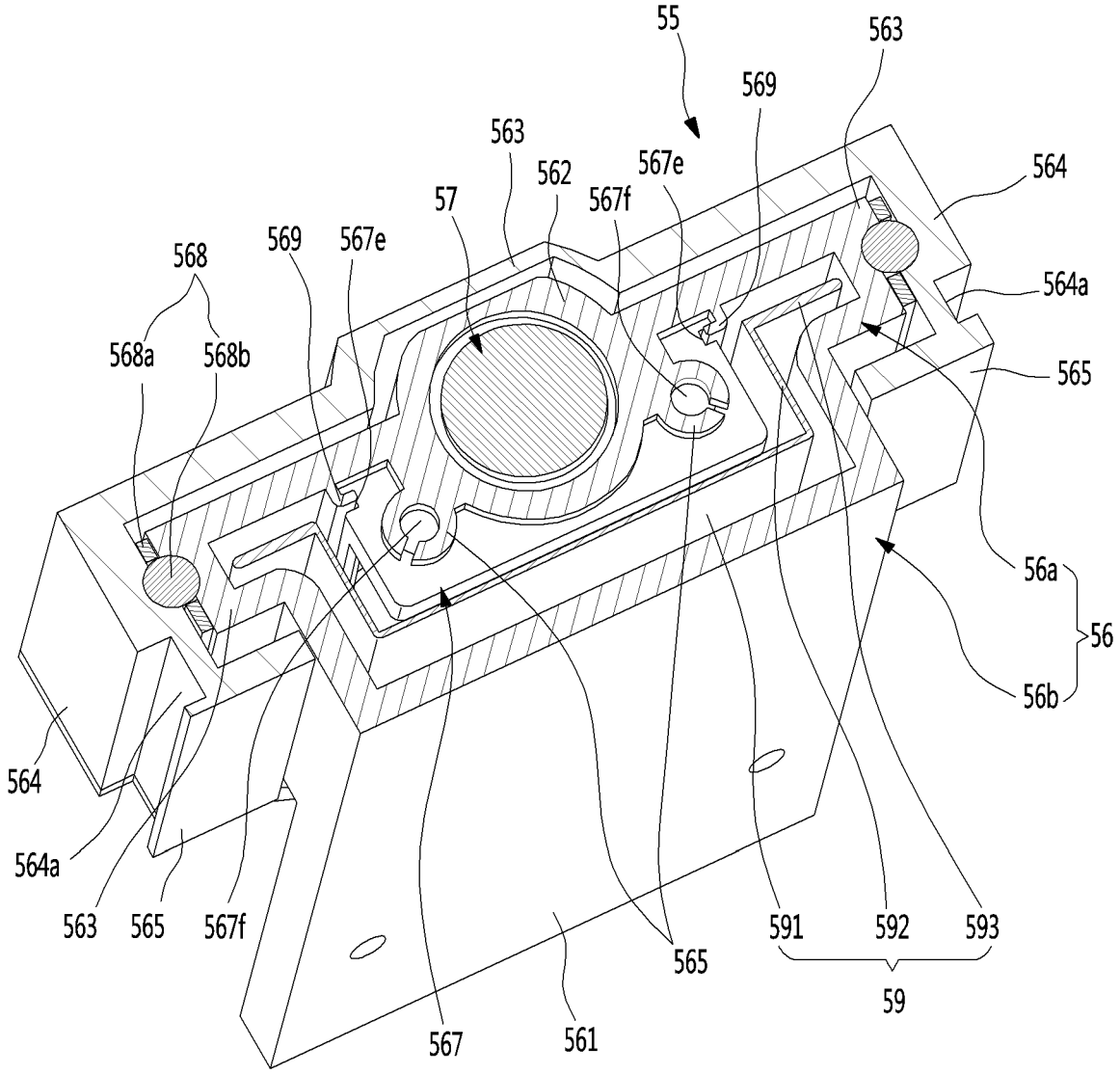
FIG. 16 is a cutaway perspective view illustrating a transverse cross-section of the elevation device.

FIG. 14 is an exploded perspective view illustrating a structure of the elevation device when viewed in one direction. FIG. 15 is an exploded perspective view illustrating the structure of the elevation device when viewed in the other direction. FIG. 16 is a cutaway perspective view illustrating a transverse cross-section of the elevation device.

As illustrated in the drawings, the elevation device 51 has an outer appearance defined by the housing 55. Also, the housing 55 may provide a space in which the elevation shaft 57 and the block holder 56 are accommodated, and the opened inner surface of the housing 55 may be covered by the rail cover 59.

The housing 55 may include the central portion 553 and the side portion 554. The central portion 553 may be disposed at a position corresponding to the elevation shaft 57, and at least a portion of the elevation shaft 57 may be accommodated in the central portion 553. Also, the central portion 553 may be seated on the first elevation device mounting part 383*c*.

The side portion 554 may extend to be stepped to both sides of the central portion 553 and be seated on the second elevation device mounting part 383*d*. The side portion 554 may extend from both side ends to both sides of the central portion 553 and be vertically bent to define both the side surfaces of the housing 55 and then be bent again inward from an end of both the side surfaces of the housing 55.

Thus, a space in which the elevation shaft 57 and the block holder 56 are accommodated may be defined in the housing 55 by the side portion 554.

Also, both ends of the side portion 554 may be bent in a direction facing each other and have a housing opening 551 therebetween. The housing opening 551 may have a horizontal width greater than a diameter of the elevation shaft 57 so that the elevation shaft 57 is easily mounted and also have a horizontal width less than a width of the block holder 56 to prevent the block holder 56 from being separated through the housing opening 551. The housing opening 551 may be covered by the rail cover 59.

The elevation shaft 57 may be accommodated in the housing 55 and disposed at the central portion 553. Also, a screw thread 4571 may be provided on an outer circumferential surface of the elevation shaft 57 so that the elevation block 567 vertically moves along the elevation shaft 57 when the elevation shaft 57 rotates.

The elevation block 567 may include a block body 567*a* having a block through-hole 567*b* through which the elevation shaft 57 passes and a body coupling part 567*d* extending from the block body 567*a* in both lateral directions. The block body 567*a* may have a cylindrical shape, and the block through-hole 567*b* may vertically pass through a center of the block body 567*a*. A screw corresponding to the screw thread 571 may be disposed on an inner circumferential surface of the block through-hole 567*b*. Thus, when the elevation shaft 57 rotates, the elevation shaft 57 may move along the screw thread 571 to allow the elevation block 567 to vertically move.

Also, a block coupling hole 567*c* may be defined in a top surface of the elevation block 567. The block coupling hole 567*c* may be defined in both sides with respect to a center of the block through-hole 567*b*. The screw 567*f* may be coupled to the block coupling hole 567*c*. Thus, the elevation block 567 may be coupled to the block holder 56 to move together with each other.

Also, the body coupling part 567*d* may extend from the center of the block body 567*a* in both directions, and a block groove 567*e* extending in the vertical direction may be defined in the extending end of the body coupling part 567*d*. The block groove 567*e* defined in each of both sides may be coupled to the block holder 56, and thus, the elevation block 567 and the block holder 56 may be more firmly coupled to each other.

The block holder 56 may be coupled to the elevation block 567 and thus be elevated together with each other inside the housing 55. Also, a portion of the block holder 56 may be exposed to the outside of the housing 55 and then coupled to the connecting bracket 65.

In detail, the block holder 56 may include an inner part 56*a* accommodated in the housing 55 and an outer part 56*b* exposed to the outside of the housing 55. Also, a hollow may be defined in the block holder 56 to provide a space 560. Particularly, a block accommodation part 564 in which the elevation block 567 is accommodated may be provided in a lower portion of the block holder 56, more particularly, a lower portion of the inner part 56*a*. The block accommodation part 564 may be opened backward and downward to communicate with the hollow. Thus, the elevation block 567 may be inserted and mounted from a lower side to an upper side of the inner part 56*a* and be disposed inside the block accommodation part 564.

A shaft through-part 562 passing in the vertical direction may be provided above the block accommodation part 564, i.e., at a center of the inner part 56*a*. The elevation shaft 57 may pass through the inside of the shaft through-part 562. Here, the screw thread 571 of the elevation shaft 57 may not be coupled to an inner circumferential surface of the shaft through-part 562 and also may not contact an inner surface of the shaft through-part 562. Also, in the state in which the elevation block 567 is disposed inside the block accommodation part 564, centers of the shaft through-part 562 and the block through-hole 567*b* may be disposed on the same extension line.

A holder coupling part 565 to which a screw 567*f* is coupled to couple the elevation block 567 to the block holder 56 may be disposed on each of both sides of an outer surface of the shaft through-part 562. The holder coupling part 565 may be disposed at a position corresponding to the block coupling hole 567*c*. Thus, the elevation block 567 and the block holder 56 may be vertically disposed when the elevation block 567 and the block holder 56 are coupled to each other. Thus, the screw 567*f* may pass through the block coupling hole 567*c* and be coupled to the holder coupling part 565, and thus, the elevation block 567 and the block holder 56 may be integrally fixed to each other.

A side extension part 563 extending in a lateral direction may be disposed on each of both sides of the shaft through-part 562. The side extension part 563 may extend laterally from the shaft through-part 562, i.e., extend up to each of both the side surfaces of the housing 55 along the side portion 554. Also, the side extension part 563 may be bent in the shape of the inner surface of the side portion 554 and may extend up to the housing opening 551. That is, the side extension part 563 may be bent in a shape corresponding to the shape of the inner surface of the side portion 554.

Also, a bearing mounting part 568 may be disposed on the side extension part 563 facing the side surface of the housing 55. The bearing mounting part 568 may be recessed inward. A plurality of bearings 568*b* may be continuously disposed in the vertical direction. The plurality of bearings 568*b* may be mounted in a state of being rotatable by a retainer 568*a*, and the retainer 568*a* may be fixed to the bearing mounting part 568. The bearing 568*b* and the retainer 568*a* may be called a rolling member. The rolling member may not be limited to the bearing 568*b* and the retainer 568*a* and thus may include a different constituent as long as the constituent is rolled between the block holder 56 and the housing 55.

The plurality of bearings 568*b* may be disposed between the inner surface of the housing 55 and the side extension part 563 to respectively contact the housing 55 and the side extension part 563, thereby performing the rolling. Also, the bearings 568*b* may be disposed on the bearing mounting part 568 disposed on each of both sides thereof. Thus, the block holder 56 may be smoothly elevated inside the housing 55. Particularly, since the block holder 56 is maintained in the state of contacting the inner surface of the housing 55 while being elevated, the block holder 56 may be stably elevated without moving. Also, the inner surface of the side portion 554 contacting the bearing 568*b* may be recessed at a position facing the bearing mounting part 568 to allow the bearing 568*b* to be more stably rolled.

The outer part 56*b* may pass through the housing opening 551 at both sides of the side extension part 563 to extend. Also, the outer part 56*b* may pass through the housing opening 551 to protrude so as to be coupled to the connecting bracket 54.

The outer part 56*b* may include the bracket mounting part 561 coupled to the connecting bracket 54, and the bracket mounting part 561 may be disposed outside the housing opening 551. Thus, even though the outer part 56*b* is elevated in the state of being coupled to the connecting bracket 54, the outer part 56*b* may not interfere with the housing 55 or the rail cover 59.

Both ends of the bracket mounting part 561 may vertically extend and respectively connected to the side extension parts 563. Here, the bracket mounting part 561 may have a thickness less than a width of the guide slit 511 to allow the block holder 56 to move along the guide slit 511.

A hollow space 560 may be defined in the block holder 56, i.e., inside the inner part 56*a* and the outer part 56*b*, and the rail cover 59 may be accommodated in the hollow space 560. Also, the block holder 56 may vertically move along the guide slit 511 defined by the rail cover 59 and the housing 55.

The bracket mounting part 561 may extend downward from the outside of the housing 55. In the state in which the block holder 56 is disposed at the lowermost side, the bracket mounting part 561 may be disposed below the housing 55. Here, the housing 55 may be disposed above the draw-out rail 33 and thus be mounted without interfering below the draw-out rail 33 and the drawer flange 380. Also, the bracket mounting part 561 may extend downward to pass through the draw-out rail 33 and be coupled to the support member 35 disposed on the bottom surface of the inside of the drawer body 38 or the connecting bracket 54 coupled to the support member 35.

Also, the block holder 56 may have a structure that extends laterally so that the side extension part 563 is accommodated in the side portion 554 and a structure that protrudes or is bent so that the outer part 56*b* passes through the housing opening 551 to restrict movement of the block holder 56, which generally moves along the housing 55, in the front and rear direction and in the left and right direction. Thus, when the support member 35 is elevated, even though a load is applied to the block holder 56, the block holder 56 may not be separated but be stably elevated.

A block restriction protrusion 569 may be disposed on each of both sides, which are adjacent to the shaft through-hole 562, of the side extension part 563. The block restriction protrusion 569 may lengthily extend in the vertical direction on the side extension part 563 and also may extend from a lower end to an upper end of the inner part 56*a*. Also, the block restriction protrusion 569 may be coupled to a block groove 567*e* defined in each of both sides of the elevation block 567. The block restriction protrusion 569 and the block groove 567*e* may be coupled to each other when the elevation block 567 moves from the lower side to the upper side of the block holder 56. Since the elevation block 567 moves upward, the whole coupling may be performed. Since the block restriction protrusion 569 and the block groove 567*e* are coupled to each other, the elevation block 567 and the block holder 56 may be more firmly coupled to each other, and also, the structure in which the elevation block 567 and the block holder 56 are elevated together with each other may be provided. The block holder 56 may have a structure that is vertically coupled to the elevation block 567. Also, the block holder 56 may have a structure that is easily molded through processing such as extrusion.

That is, since a screw has to be provided to move along the elevation shaft 57, the structure may be complicated, and also, it may be difficult to mold the elevation block 567 having abrasion resistance and lubrication performance through engineering plastic injection molding. Also, the elevation block 567 to which a load is applied substantially when the support member 35 moves may have to have high strength. Thus, the elevation block 567 may have a structure that is capable of being molded by using a metal material through the extrusion. The elevation block 567 and the block holder 56, which are made of different materials, may be coupled to each other and may be integrally elevated inside the housing 55 to match the respective structure and environment.

A lower spacer 586 on which the elevation shaft 57 is rotatably supported may be disposed below the elevation shaft 57. A lower protrusion 437 protruding downward may be inserted into the elevation shaft 57. The lower spacer may have the same structure as the bearing. Thus, the elevation shaft 57 may rotate in the state of being supported on the lower spacer 586.

The lower spacer 586 may be fixed and mounted on the lower cap 585. The lower cap 585 may be mounted to cover the opened bottom surface of the housing 55 and define the bottom surface of the elevation device 51. A lower spacer seating part 585*s* into which the lower spacer 586 is inserted and mounted may be disposed at a center of the lower cap 585. Also, a lower cap coupling part 585*c* may be disposed on each of both sides of the lower spacer seating part 585*a*. A screw passing through the side portion 554 of the housing 55 may be coupled to the lower cap coupling part 585*c*. Also, a central portion of the lower cap 585 may have a shape corresponding to the central portion 553 of the housing 55 and be inserted into the central portion 553. Each of both ends of the lower cap 585 may protrude in both directions and be inserted into the side portion 554 of the housing 55 to cover the opened bottom surface of the housing 55.

The elevation shaft 57 may extend up to the upper end of the housing 55, and the shaft gear 572 and an upper spacer 584 may be mounted on the elevation shaft 57.

The shaft gear 572 may be disposed on an upper end of the screw thread 571 and be integrally coupled to the elevation shaft 57 to rotate together with the elevation shaft 57. Also, the shaft gear 572 may be gear-coupled to the drawer-side shaft 52 in the state of perpendicularly crossing the drawer-side gear 523 mounted on the drawer-side shaft 52.

An upper protrusion 573 extending upward may be disposed on the upper end of the elevation shaft 57. Also, the upper spacer 584 and a spacer fixing member 583 may be mounted to pass through the upper protrusion 573.

The spacer fixing member 583 may be penetrated at a center thereof by the elevation shaft 57, and an upper spacer seating part 583*a* on which the upper spacer 584 is seated may be disposed on a top surface of the spacer fixing member 583. The upper spacer seating part 583*a* may be recessed downward to accommodate at least a portion of the upper spacer 584. Also, a spacer fixing member coupling part 583*b* fixed to the inner surface of the housing 55 may be disposed on each of both sides of the spacer fixing member 583. Thus, the coupling member such as the screw passing through the housing 55 may be coupled to the spacer fixing member coupling part 583*b*, and the fixed state of the spacer fixing member 583 may be maintained.

As described above, the upper and lower ends of the elevation shaft 57 may be rotatably supported by the upper spacer 584 and the lower spacer 586. Also, the elevation shaft 57 may rotate by the power transmitted to the shaft gear 572 by the drawer-side gear 523, and the elevation block 567 and the block holder 56 may be elevated by the power.

The upper cap 581 may be disposed on the upper end of the housing 55. The upper cap 581 may cover the opened top surface of the housing 55 and define the top surface of the elevation device 51.

A cap protrusion 581*a* protruding upward may be disposed on the top surface of the upper cap 581, and the cap protrusion 581*a* is inserted into a protrusion hole 531 defined in the mounting part bracket 53 to restrict the upper end of the elevation device 51.

Also, a cap coupling part 581*e* may be disposed inside the upper cap 581. The cap coupling part 581*e* may have the same shape as a boss and extend to the inner surface of the housing 55. An end of the cap coupling part 581*e* may extend to contact the side portion 554, and the coupling member such as the screw passing through the housing 55 may be coupled to the end of the coupling part 581*e*. The upper cap 581 may be firmly fixed to the housing 55 by the coupling member.

The inner surface of the upper cap 581 and the inner surface of the housing 55 may be spaced apart from each other by the cap coupling part 581*e* and provide a space in which the drawer-side gear 523 and the shaft gear 572 are disposed. That is, the drawer-side gear 523 and the shaft gear 572 may be disposed to be coupled to each other in the inner region of the upper cap 581.

A guide protrusion 581*c* may be disposed on one surface of the upper cap 581 covering the housing opening 551. The guide protrusion 581*c* may protrude from a position corresponding to each of both ends of the housing opening 551 and have a thickness corresponding to that of the housing 55.

Also, a housing support part 581*b* extending to be stepped in both directions of the guide protrusion 581*c* may be provided. The housing support part 581*b* is configured to support the side portion 554 of the housing 55 in the state in which the upper cap 581 is mounted on the housing 55.

Thus, the upper cap 581 may be inserted through the opened upper side of the housing 55, and the mounting of the upper cap 581 may be guided by the guide protrusion 581*c*. Also, the opened top surface of the housing 55 may be covered by a top surface of the upper cap 581, and the upper cap 581 may be fixed to the housing by the coupling member.

The rail cover 59 may be disposed on the housing 55. The rail cover 59 may cover the housing opening 551 and define the guide slit 511.

In detail, the rail cover 59 may be made of a plate-shaped metal material like the inner side plate 392. Thus, in the state in which the rail cover 59 is mounted, the outer appearance of the elevation device 51 may be have the same texture as the outer appearance of the inside of the drawer part 32, i.e., the inner side plate 392.

The rail cover 59 may cover the housing opening 551 to cover the constituents accommodated in the housing 55. For this, the rail cover 59 may include a cover covering part 591 disposed on an area of the housing opening 551, a cover bent part 592 bent from the cover covering part 591 to the inside of the housing 55, and a cover extension part 593 bent outward from the extending end of the cover bent part 592 and inserted into the side extension part 563. Also, upper and lower ends of the rail cover 59 may be coupled and fixed to the upper cap 581 and the lower cap 585.

A cover cutoff part 594 that is cut downward in a stepped shape may be provided in each of both left and right surfaces of the upper end of the rail cover 59. The cover cutoff part 594 may be seated on the upper cap 581 when the rail cover 59 is mounted.

The rail cover 59 may have a cross-sectional shape corresponding to the hollow shape within the block holder 56 to pass through the hollow of the block holder 56. Thus, the block holder 56 may vertically move in a state of being penetrated by the rail cover 59.

Also, the cover covering part 591 may have a horizontal width less than that of the housing opening 551. That is, when the rail cover 59 is mounted, an outer end of the cover covering part 591 and an inner end of the housing opening 551 may be spaced apart from each other to provide the guide slit that extends in the vertical direction.

The cover covering part 591 may have a horizontal width corresponding to a thickness of a portion of the guide slit 511 defining both the side surfaces of the outer part 56*b*. Both the side surfaces of the outer part 56*b* may pass through the guide slit 511 and move along the guide slit 511 when the block holder 56 vertically moves.

The cover extension part 593 may extend from the end of the cover bent part 592 up to the inside of the side extension part 563 via the inner end of the housing opening 551. That is, a distance between both ends of the cover extension part 593 may be greater than a size of the housing opening 551.

Thus, in the state in which the rail cover 59 is mounted, most of the housing opening 551 may be covered by the cover covering part 591 and also be defined as the guide slit 511. Also, the inside of the guide slit 511 may also be covered by the cover extension part 593. Thus, the outer appearance of the inside of the housing opening 551 may be defined by the guide slit 511, and thus, the inside of the drawer part 32 may have the same metal texture on the whole. Also, most of the inner surface of the drawer part 32, on which the elevation device 51 is mounted, except for the gap by the guide slit 511 may be covered by the metal material to improve the outer appearance thereof.

Figure 17:
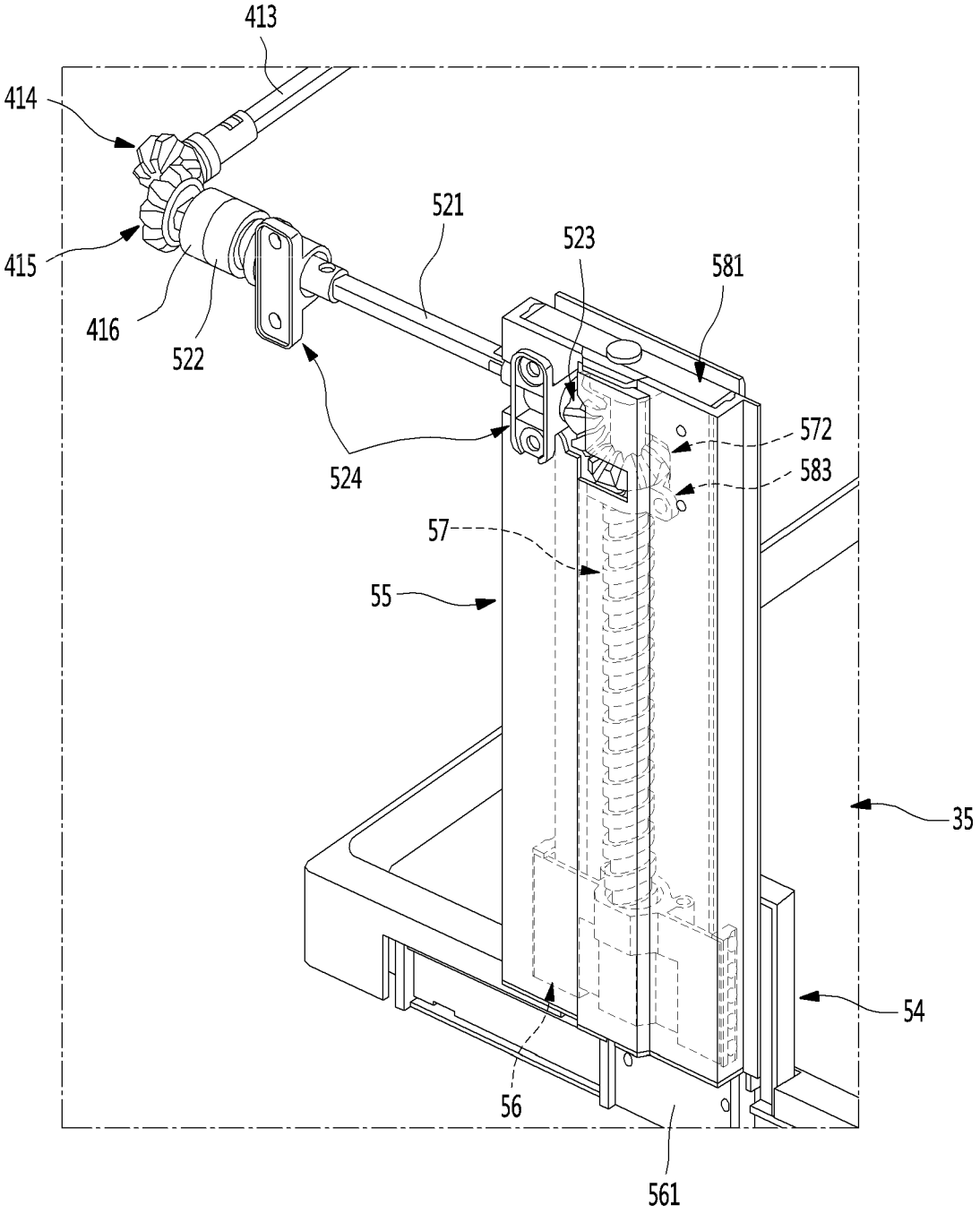
FIG. 17 is a partial perspective view illustrating a power transmission structure of the drawer-side device.
Figure 18:
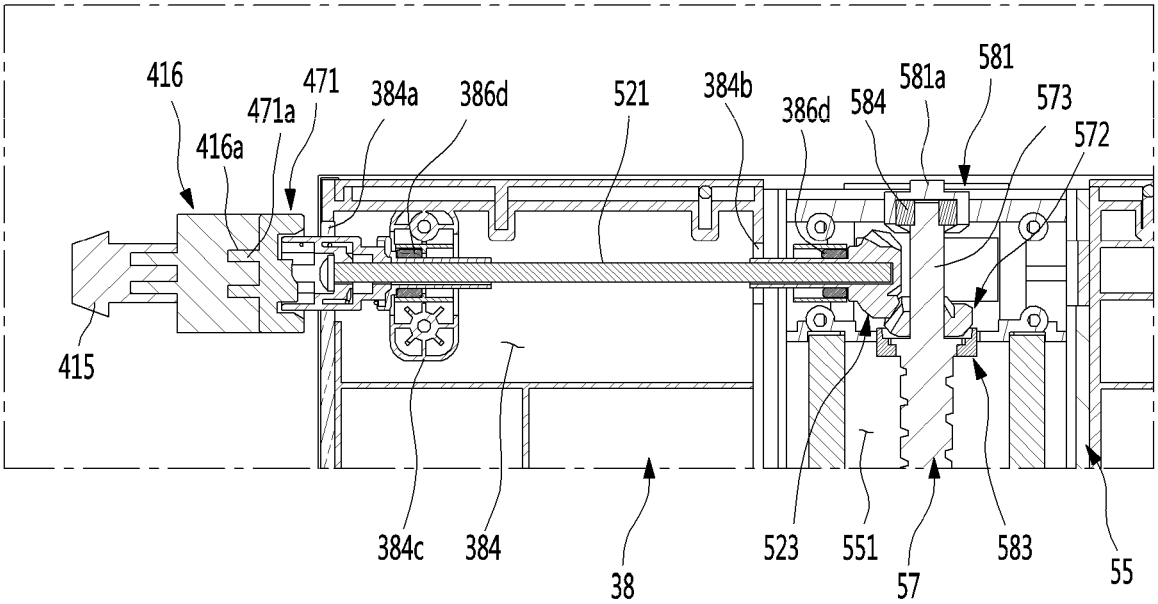
FIG. 18 is a perspective view illustrating a mounting structure of a drawer shaft of the drawer-side device of the elevation assembly.

FIG. 17 is a partial perspective view illustrating a power transmission structure of the drawer-side device. FIG. 18 is a perspective view illustrating a mounting structure of the drawer shaft of the drawer-side device of the elevation assembly.

As illustrated in the drawings, the shaft mounting part 384 may be disposed on each of both the side ends of the drawer body 38. The shaft mounting part 384 may be disposed in a region between the front surface of the drawer body 38 and the elevation device mounting part 383 to provide a space in which the drawer-side shaft 52 is mounted.

Also, the front end of the shaft mounting part 384 may include a front opening 384*a* of which at least a portion of a front end is opened so that the shaft mounting part 384 communicates with the front surface of the drawer body 38 and a rear opening 384*b* of which at least a portion of a rear end is opened so that the shaft mounting part 384 communicates with the elevation device mounting part 383.

Also, the drawer-side shaft 52 may be disposed on the shaft mounting part 384. Also, the shaft fixing member 524 for fixing the drawer-side shaft 52 may be provided, and a mounting part 384*c* for mounting the shaft fixing member 524 may be further provided.

In detail, the drawer-side shaft 52 may extend from the front opening 384*a* to the rear opening 384*b*. Also, the drawer-side shaft 52 may include a drawer shaft 521 having a predetermined length.

The drawer connection member 522 may be coupled to the front end of the drawer shaft 521, and the drawer connection member 522 may be exposed to the front surface of the drawer part 32 through the front opening 384*a*. Also, as described above, the drawer connection member 522 may be coupled to the door connection member 416 when the front panel door part 31 and the drawer part 32 are coupled to each other and may rotate together with the driving of the door-side device 41.

Also, the drawer-side gear 523 may be disposed on the rear end of the drawer shaft 521. The drawer-side gear 523 may have a bevel gear shape and be coupled to the shaft gear 572 through the rear opening 384*b*. That is, the drawer-side shaft 52 and the elevation shaft 57, which are disposed to perpendicularly cross each other, may be connected to each other by the drawer-side gear 523 and the shaft gear 572 to transmit the power.

Here, the rear end of the drawer-side shaft 52, i.e., the rear end of the drawer shaft 521 and the drawer-side gear 523 mounted on the rear end of the drawer shaft 521 may be inserted through the shaft insertion hole 552 of the housing 55 via the rear opening 384*b*. Thus, the rear end of the drawer-side shaft 52 including the drawer-side gear 523 may be disposed in the inner region of the upper cap 581 of the elevation device 51.

Also, the shaft fixing member 524 may be disposed on the drawer-side shaft 52. The shaft fixing member 524 may be provided in a pair on both left and right sides to support the drawer-side shaft 52 so that the drawer-side shaft 52 is rotatable without being tilted or moving. The front shaft fixing member 524 of the pair of shaft fixing members 524 may be fixed and mounted on the mounting part 384*c* of the shaft mounting part 384, and at least a portion of the rear shaft fixing member 524 may be accommodated in the housing 55.

A through-hole through which the drawer shaft 521 passes may be defined in the shaft fixing member 524, and a bearing may be provided in the through-hole to support the drawer shaft 521. Thus, the shaft fixing member 524 may stably support the drawer-side shaft 52 and be configured so that the drawer-side shaft 52 is rotatably mounted.

The mounting part 384*c* may be provided in a pair on the shaft mounting part 384 and be coupled to the shaft fixing member 524. A center of the mounting part 384*c* may be recessed so that a portion of the shaft fixing member 524 is accommodated, and the shaft fixing member 524 may be fixed and mounted on the mounting part 384*c* by the screw.

The drawer-side shaft 52 may be mounted on the outer surface of the drawer body 38, and the elevation device 51 may be mounted on the inner surface of the drawer body 38. Also, the elevation device mounting part 383 on which the elevation device 51 is mounted and the shaft mounting part 386 on which the drawer-side shaft 52 is mounted may communicate with each other through the rear opening 384*b*. Also, the drawer-side gear 523 disposed on the rear end of the drawer-side shaft 52 may be connected to the shaft gear 572 inside the elevation device 51 through the rear opening 384*b*.

Hereinafter, a state in which the drawer door 30 of the refrigerator 1 is inserted and withdrawn and is elevated according to an embodiment will be described in more detail with reference to the accompanying drawings.

Figure 19:
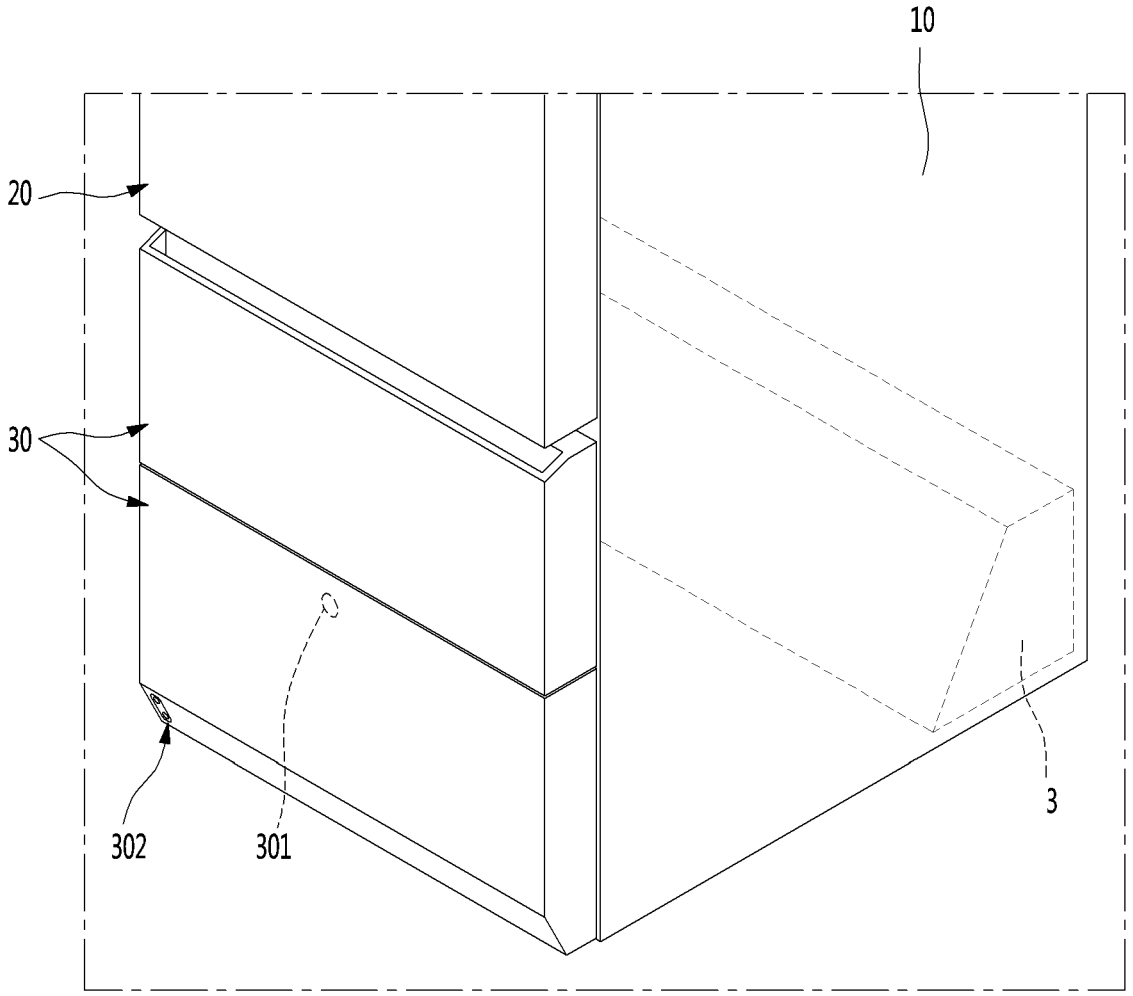
FIG. 19 is a perspective view illustrating a state in which the drawer door is closed.

FIG. 19 is a perspective view illustrating a state in which the drawer door is closed.

As illustrated in the drawing, in the state in which the food is stored, the refrigerator 1 may be maintained in a state in which all of the rotation door 20 and the drawer door 30 are closed. In this state, the user may withdraw the drawer door 30 to accommodate the food.

The drawer door 30 may be provided in plurality in a vertical direction and be withdrawn to be opened by the user's manipulation. Here, the user's manipulation may be performed by touching the manipulation part 301 disposed on the front surface of the rotation door 20 or the drawer door 30. Alternatively, an opening command may be inputted on the manipulation device 302 provided on the lower end of the drawer door 30. Also, the manipulation part 301 and the manipulation device 302 may individually manipulate the insertion and withdrawal of the drawer door 30 and the elevation of the support member 35. Alternatively, the user may hold a handle of the drawer door 30 to open the drawer door 30.

Hereinafter, although the lowermost drawer door 30 of the drawer doors 30, which are disposed in the vertical direction, is opened and elevated as an example, all of the upper and lower drawer doors 30 may be inserted and withdrawn and elevated in the same manner.

Figure 20:
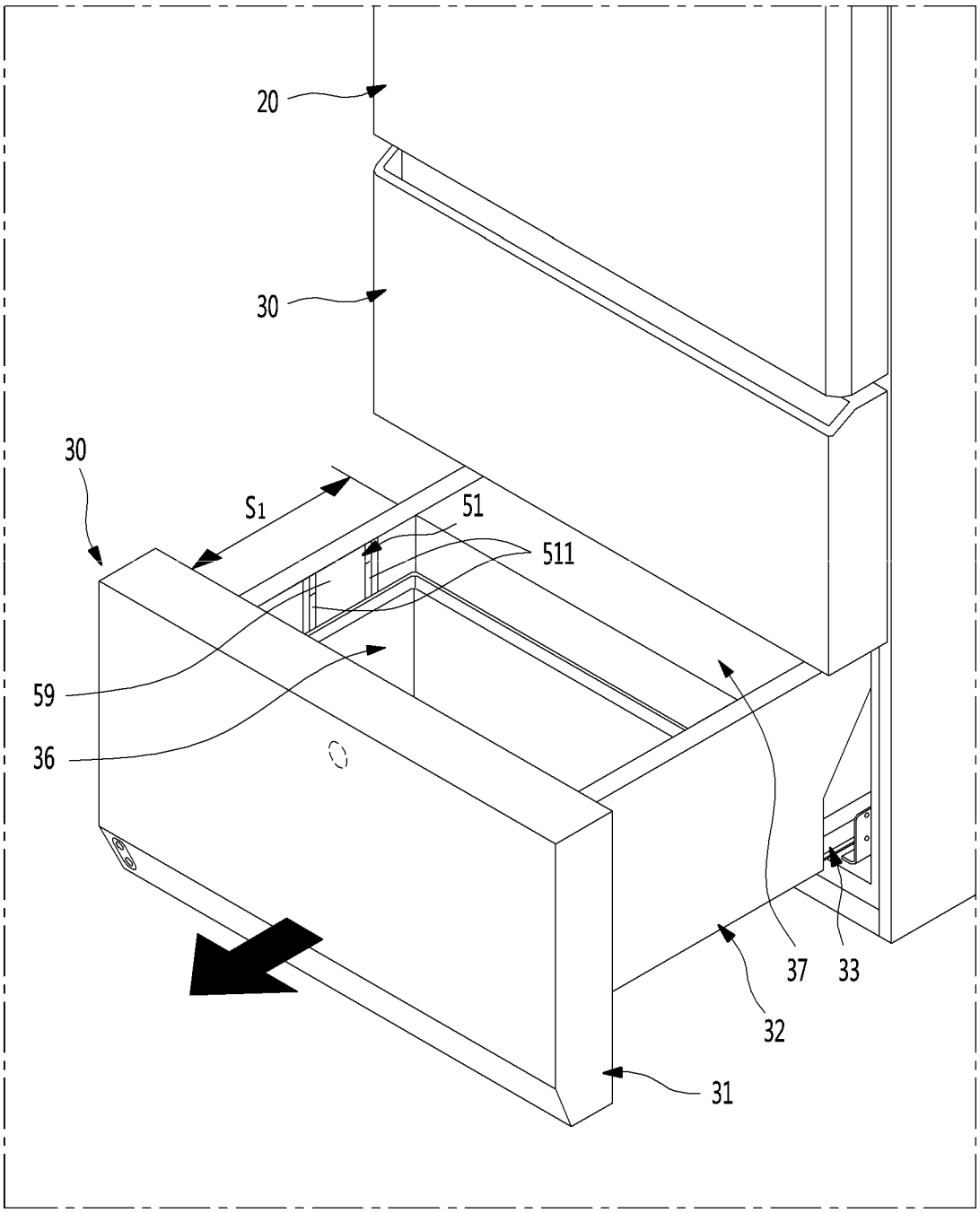
FIG. 20 is a perspective view illustrating a state in which the drawer door is completely opened.
Figure 21:
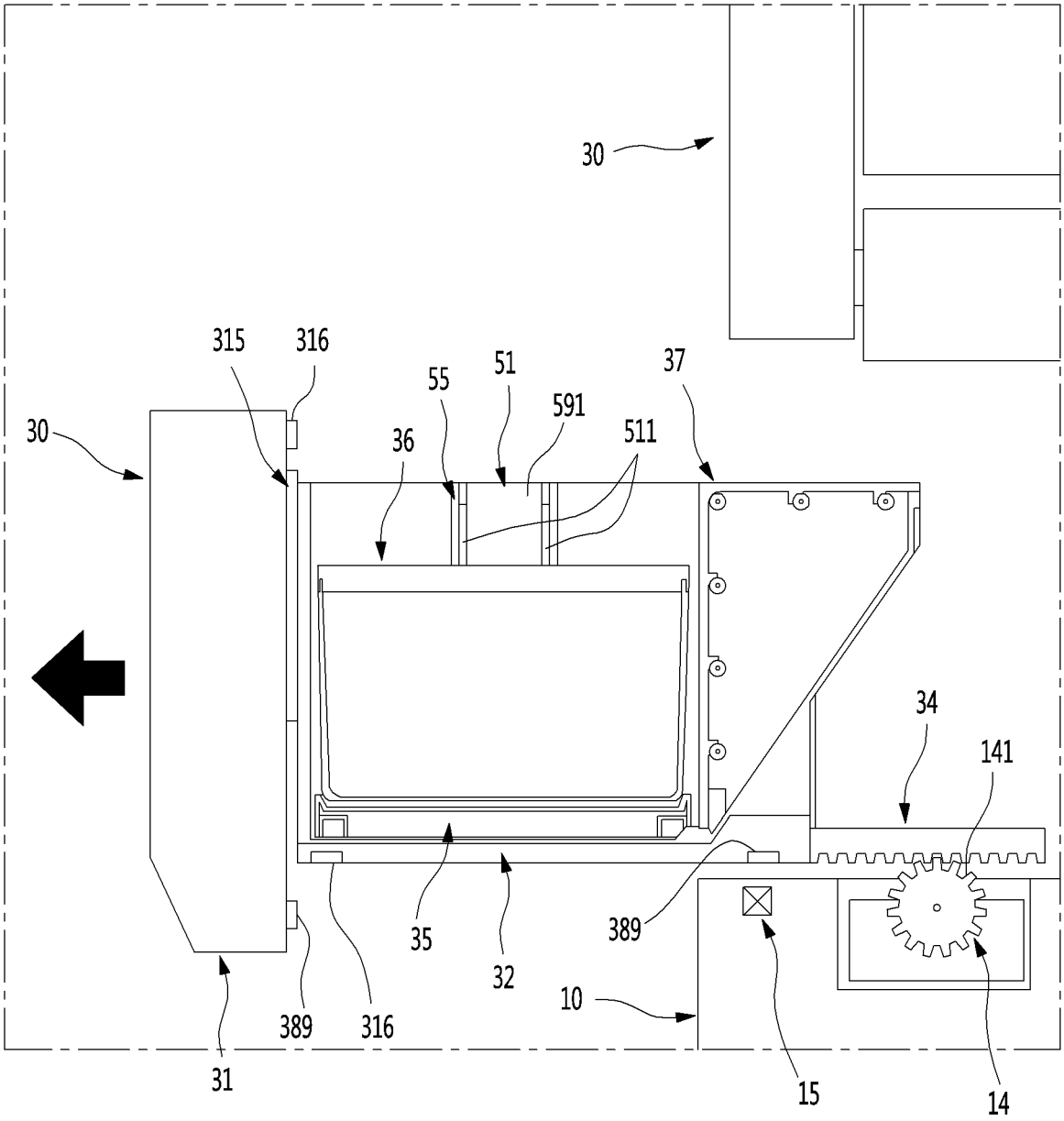
FIG. 21 is a cross-sectional view of the drawer door in the state of FIG. 20.

FIG. 20 is a perspective view illustrating a state in which the drawer door is completely opened. FIG. 21 is a cross-sectional view of the drawer door in the state of FIG. 20.

As illustrated in the drawings, the user may manipulate the draw-out operation on the drawer door 30 to withdraw the drawer door 30 forward. The drawer door 30 may be withdrawn while the draw-out rail 33 extends.

The drawer door 30 may be configured to be inserted and withdrawn by the driving of the draw-out motor 14, not by a method of directly pulling the drawer door 30 by the user. The draw-out rack 34 provided on the bottom surface of the drawer door 30 may be coupled to the pinion gear 141 rotating when the draw-out motor 14 provided in the cabinet 10 is driven. Thus, the drawer door 30 may be inserted and withdrawn according to the driving of the draw-out motor 14.

The draw-out distance of the drawer door 30 may correspond to a distance at which the front space S1 within the drawer part 32 is completely exposed to the outside. Thus, in this state, the support member 35 may not interfere with the doors 20 and 30 disposed thereabove or the cabinet 10.

Here, the draw-out distance of the drawer door 30 may be determined by a draw-out detection device 15 disposed on the cabinet 10 and/or the drawer door 30. The draw-out detection device 15 may be provided as a detection sensor that detects a magnet 389 to detect a state in which the drawer door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the drawer door 30 is closed and a position of the magnet 389 when the drawer door 30 is completely withdrawn. Thus, the draw-out state of the drawer door 30 may be determined by the draw-out detection device 15.

Also, as necessary, a switch may be provided at each of positions at which the drawer door 30 is completely inserted and withdrawn to detect the draw-out state of the drawer door 30. In addition, the draw-out state of the drawer door 30 may be detected by counting the rotation number of draw-out motor 14 or measuring a distance between the rear surface of the front panel door part 31 and the front end of the cabinet 10.

In the state in which the drawer door 30 is completely withdrawn, the elevation motor 411 may be driven to elevate the support member 35. The support member 35 may be driven in an even situation in which the drawer door 30 is sufficiently withdrawn to secure safe elevation of the food or container 36 seated on the support member 35.

That is, in the state in which the drawer door 30 is withdrawn to completely expose the front space to the outside, the support member 35 may ascend to prevent the container 36 or the stored food seated on the support member 35 from interfering with the doors 20 and 30 or the cabinet 10.

The ascending of the support member 35 may start in a state in which the drawer door 30 is completely withdrawn. Also, to secure the user's safety and prevent the food from being damaged, the ascending of the support member 35 may start after a set time elapses after the drawer door 30 is completely withdrawn.

After the drawer door 30 is completely withdrawn, the user may manipulate the manipulation part 301 to input the ascending of the support member 35. That is, the manipulation part 301 may be manipulated to withdraw the drawer door 30, and the manipulation part 301 may be manipulated again to elevate the support member 35. Also, the drawer door 30 may be manually inserted and withdrawn by a user's hand. After the drawer door 30 is withdrawn, the manipulation part 301 is manipulated to elevate the support member 35.

Figure 22:
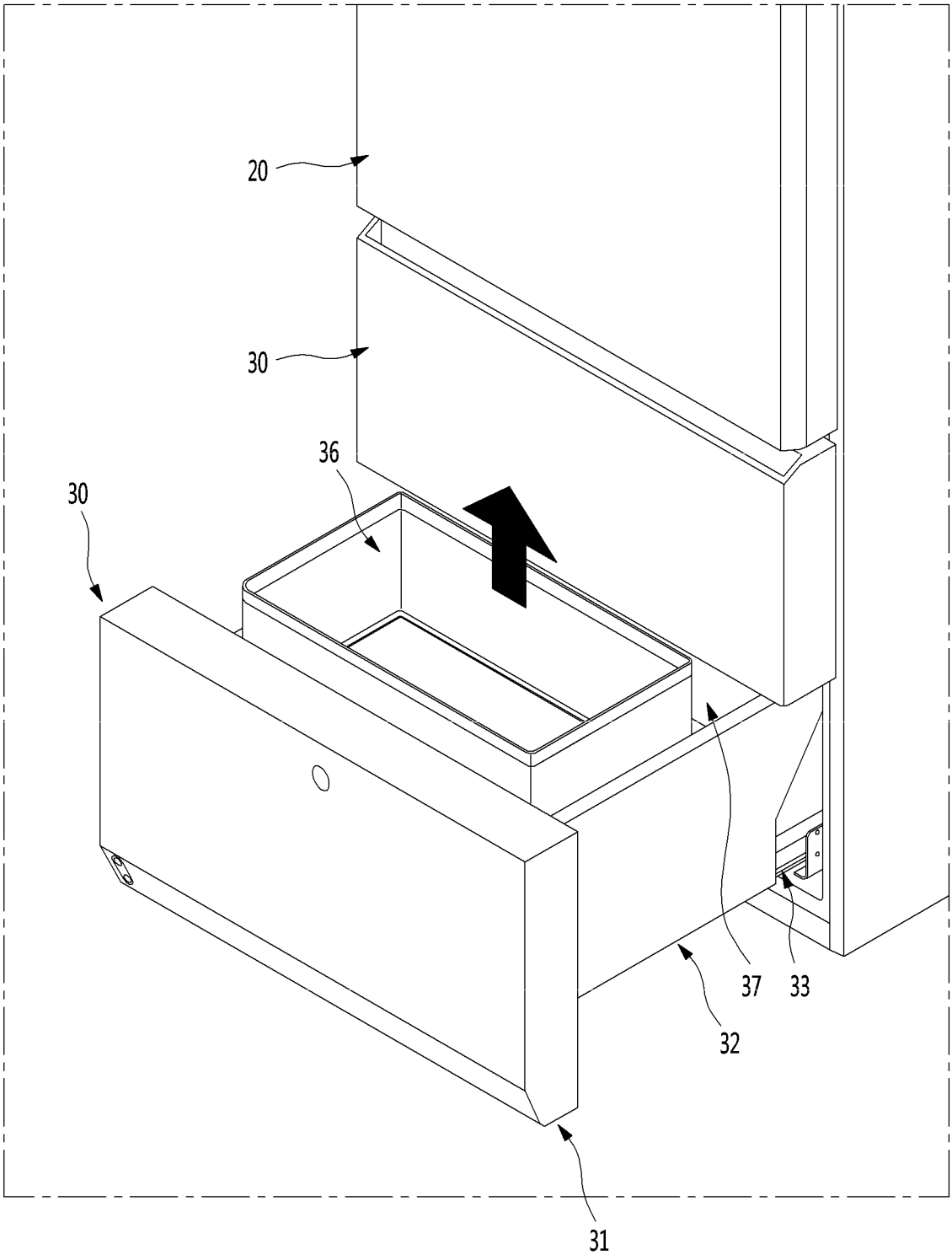
FIG. 22 is a perspective view illustrating a state in which a support member of the drawer door is completely elevated.
Figure 23:
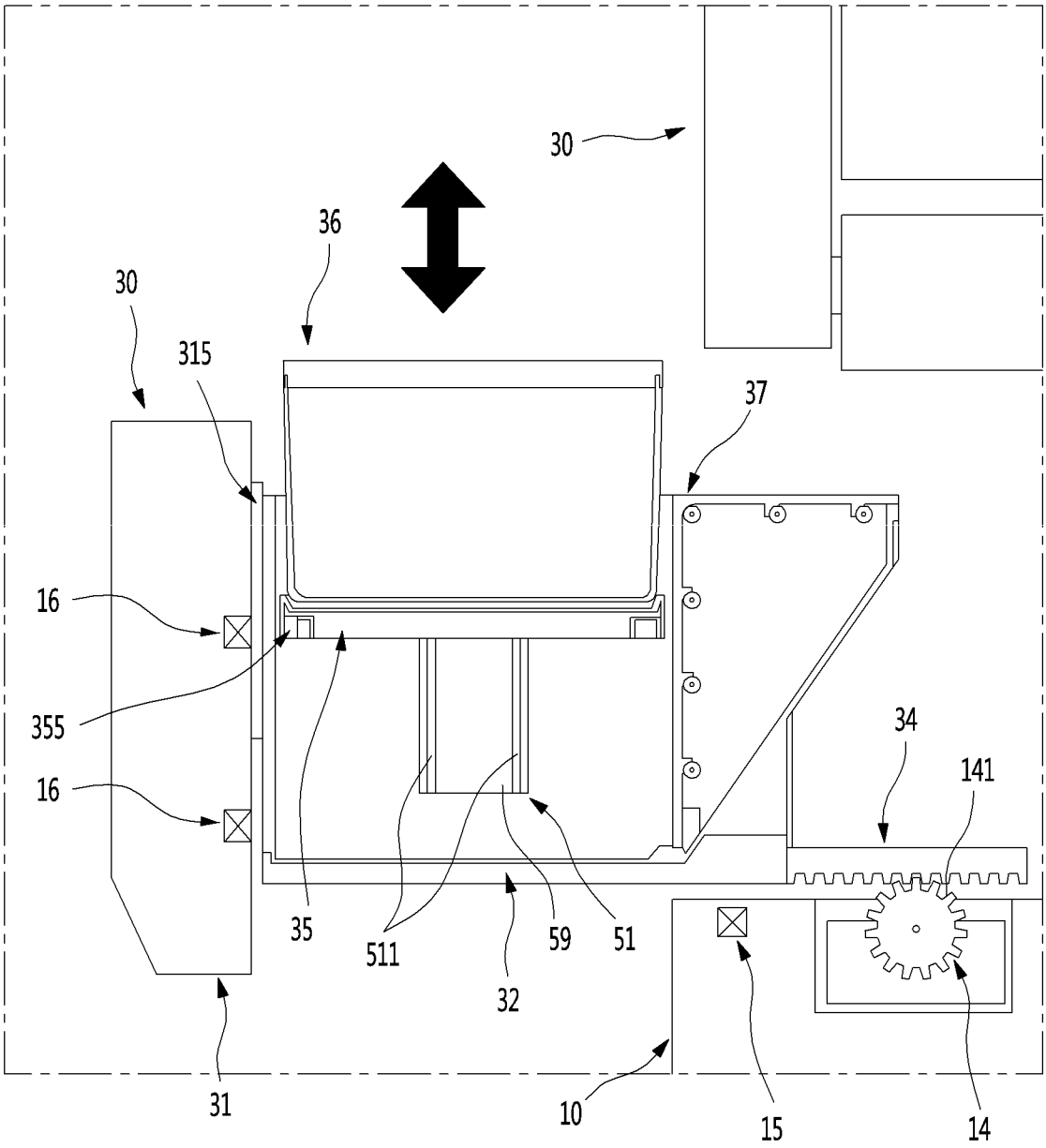
FIG. 23 is a cross-sectional view of the drawer door in the state of FIG. 22.

FIG. 22 is a perspective view illustrating a state in which the support member of the drawer door is completely elevated. FIG. 23 is a cross-sectional view of the drawer door in the state of FIG. 22.

In the state of FIGS. 20 and 21, the elevation of the support member 35 may be performed in the state in which the drawer door 30 is withdrawn. The support member 35 may be elevated by the operation of the elevation motor 411. In the state in which the door-side device 40 of the front panel door part 31 and the drawer-side device 50 of the drawer part 32 are coupled to each other, the power may be transmitted to elevate the support member 35.

In more detail, when the elevation motor 411 operates, the door-side shafts 413 connected to the elevation motor 411 may rotate, and also the first gear 414 and the second gear 415 connected to the door-side shaft 413 may rotate.

The rotation force of the door-side device 41 may be transmitted to the drawer-side device 50 by door connection member 416 and the drawer connection member 522, which are coupled to each other. Thus, the rotation force transmitted from the door-side device 41 may allow the drawer-side shaft 52 and the drawer-side gear 523 of the end of the drawer-side shaft 52 to rotate.

The rotation force may be transmitted in the state in which the drawer-side gear 523 and the shaft gear 572 are connected to each other, and the rotation force of the drawer-side shaft 52 may allow the elevation shaft 57 to rotate. Due to the rotation of the elevation shaft 57, the elevation block 567 and the block holder 56 may move upward along the elevation shaft 57. Here, all of the portions of the elevation device 51, which is exposed to the inside of the drawer part 32, may be covered by the rail cover 59. Also, the block holder 56 may vertically move along the guide slit 511 defined by the rail cover 59.

Here, the block holder 56 may vertically move together with the connecting bracket 54 in the state of being coupled to the connecting bracket 54, and the support member 35 coupled to the connecting bracket 54 may also move upward. Here, the connecting bracket 54 may be connected to a center of both side surfaces of each of the support member 35, and the elevation device 51 may also be disposed at a center of each of both side surfaces of support member 35 to allow the support member 35 to be stably elevated without being tilted.

Particularly, the ascending block holder 56 may have the corresponding stepped or bent shape within the housing 55 and thus be restricted so that the block holder 56 does not move in the left and right direction or in the front and rear direction during the ascending.

The support member 35 may continuously ascend by a sufficient height so that the user is accessible to the food or container 36 seated on the support member 35. Thus, the user may easily lift the food or container.

The support member 35 may ascend until the block holder 56 is disposed at the upper end of the guide slit. When the ascending of the support member 35 is completed, the driving of the elevation motor 411 is stopped.

When an ascending completion signal is inputted, the driving of the elevation motor 411 may be stopped. For this, a height detection device 16 for detecting a position of the support member 35 may be provided. The height detection device 16 may be provided in the front panel door part 31 at a height corresponding to the uppermost ascending position of the support member 35 and the lowermost descending position of the support member 35.

The height detection device 16 may be provided as a detection sensor that detects a magnet 355. The height detection device 16 may detect the magnet 355 disposed on the support member 35 to determine whether the ascending of the support member 35 is completed. Also, the height detection device 16 may be provided as a switch structure to turn on the switch when the support member 35 maximally ascends. Also, the height detection device 16 may be provided on the elevation rail 44 or the elevation shaft 57 to detect the maximally ascending position of the support member 35. Also, whether the support member 35 maximally ascends may be determined according to a variation in load applied to the elevation motor 411.

The driving of the elevation motor 411 is stopped in the state in which the support member 35 maximally ascends. In this state, although the support member 35 is disposed inside the drawer part 32, the food or container 36 seated on the support member 35 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

After the user's food storing operation is completed, the user may allow the support member 35 to descend by manipulating the manipulation part 301. The descending of the support member 35 may be performed by reverse rotation of the elevation motor 411 and may be gradually performed through the reverse procedure with respect to the above-described procedure.

Also, when the descending of the support member 35 is completed, i.e., in the state of FIG. 20 or 21, the completion of the descending of the support member 35 may be performed by the height detection device 16. The height detection device 16 may be further provided at a position that detects the magnet disposed on the support member 35 when the support member 35 is disposed at the lowermost descending position. Thus, when the completion of the descending of the support member 35 is detected, the driving of the elevation motor is stopped.

Also, after the driving of the elevation motor 411 is stopped, the drawer door 30 may be inserted. Here, the drawer door 30 may be closed by the user's manipulation or by the driving of the draw-out motor 14. When the drawer door 30 is completely closed, a state of FIG. 17 may become.

In addition to the foregoing embodiment, various embodiments may be exemplified.

Hereinafter, another embodiment will be described with reference to the accompanying drawings. In the other embodiments of the present disclosure, the same reference numerals are used for the same components as those of the above-described embodiments, and a detailed description thereof will be omitted.

Figure 24:
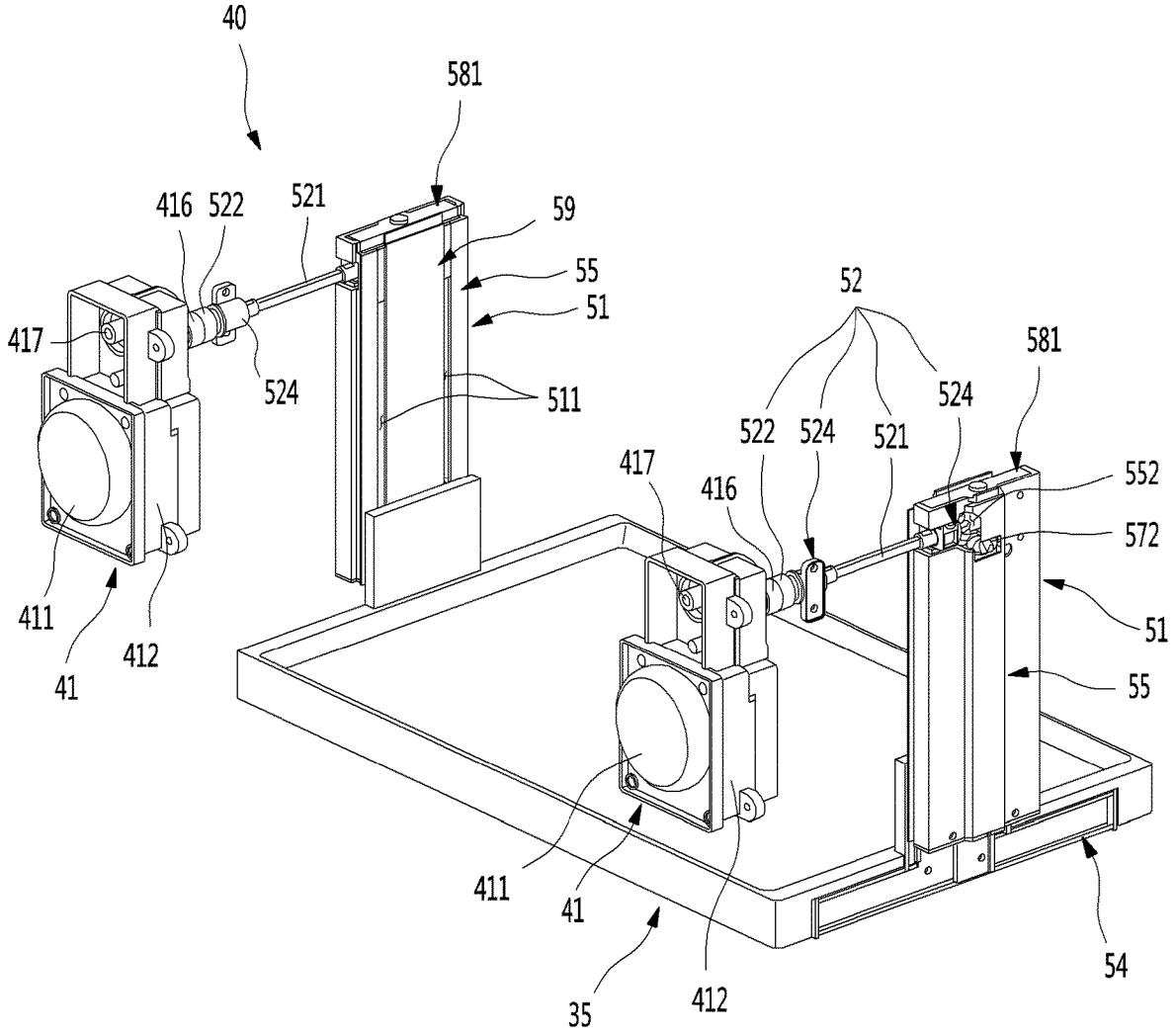
FIG. 24 is a perspective view illustrating a structure of an elevation assembly according to another embodiment.

FIG. 24 is a perspective view illustrating a structure of an elevation assembly according to another embodiment.

As illustrated in the drawings, an elevation assembly 40 according to another embodiment may include a door-side device 41 and a drawer-side device 50. The door-side device 41 may be provided in a front panel door part 31 of a drawer door 30, and the drawer-side device 50 may be provided in a drawer part 32 of a drawer door 30. When the front panel door part 31 and the drawer part 32 are coupled to each other, the drawer-side device 50 and the door-side device 41 may be connected to each other to transmit power. Also, the door-side device 41 and the drawer-side device 50 may be separated from each other. Thus, the front panel door part 31 and the drawer part 32 may be separated from each other.

The door-side device 41 may be provided in the front panel door part 31 and include an elevation motor 411, a motor assembly 412 including gears connected to the elevation motor 411, a door-side shaft 417 connected to the motor assembly 412 to rotate, and a door connection member 416 disposed on an end of the door-side shaft 417.

Here, a motor shaft of the elevation motor 411 may be disposed in a front and rear direction. The motor assembly 412 may have a width direction in parallel to a front surface of the front panel door part 31 to minimize a depth occupied by installing the motor assembly 412 in the front panel door part 31. Also, the door-side shaft 417 may be disposed in the front and rear direction and connected to the door connection member 416. Also, if necessary, the door-side shaft 417 and the door connection member 416 may be integrated with each other.

Also, each of the motor assembly 412, the door-side shaft 417, and the door connection member 416 may be provided in a pair, which are disposed on both left and right sides and have the same structure. Also, the elevation motors 411 disposed on both sides may operate together with each other and also operate at the same time so that the support member 35 is elevated in a horizontal state without being tilted and generate rotation force having the same intensity.

The elevation motor 411 may be disposed on each of both the left and right sides. Thus, when compared with a case in which one elevation motor is provided, the elevation motor 411 may decrease in size to minimize a thickness of the motor assembly 412 in the front and rear direction. Thus, an insulation thickness of the front panel door part 31 may be sufficiently secured.

Also, the pair of elevation motors 41 may be used to provide larger force to the support member 35. Thus, the more stable elevation operation of the support member 35 may be secured in the even state in which a heavy food or container is seated on the support member 35.

The drawer-side device 50 may be connected to the door-side device 41. Since the rawer-side device 50 has the same structure as the rawer-side device according to the foregoing embodiment, its detailed description will be omitted.

Figure 25:
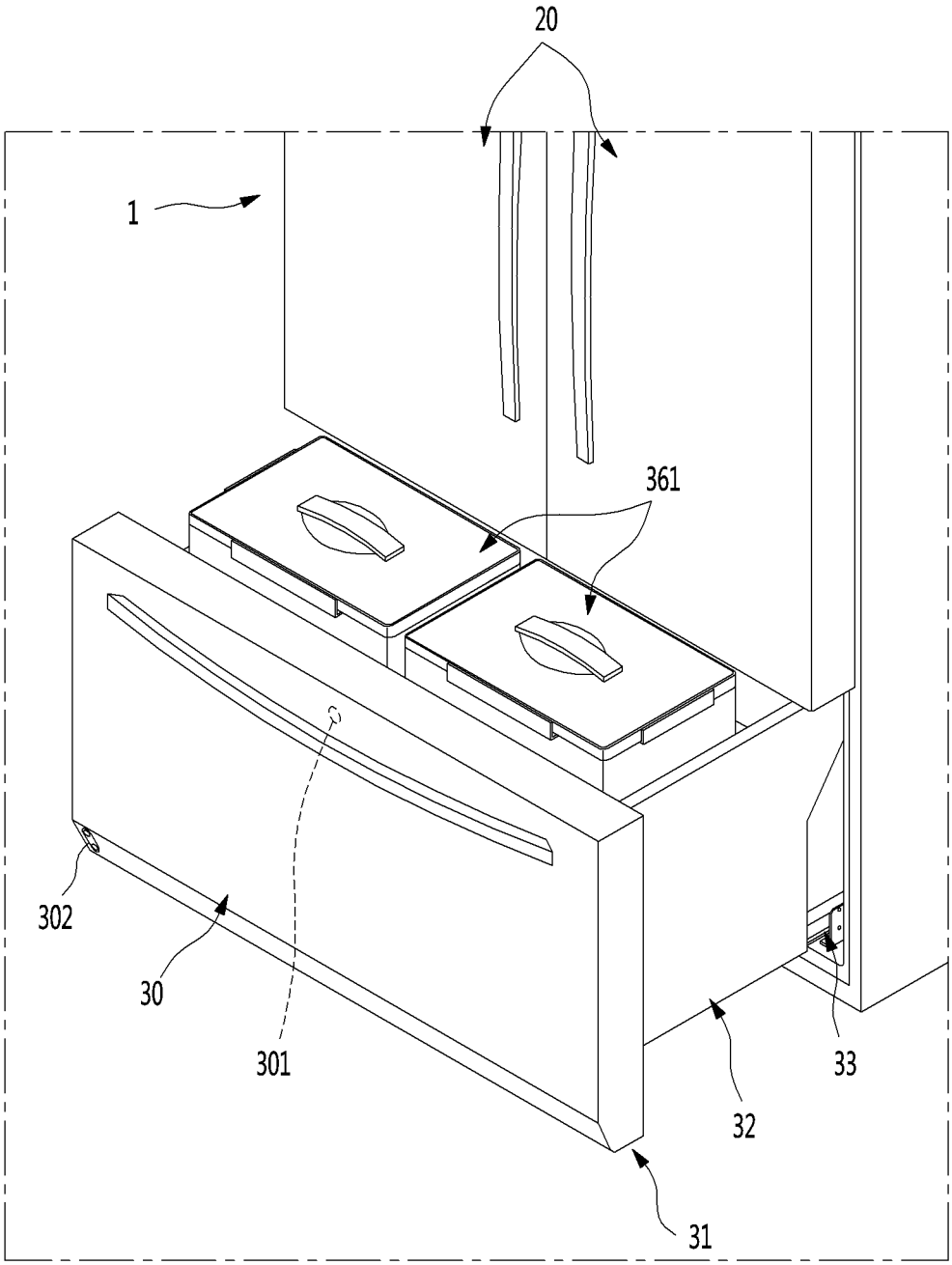
FIG. 25 is a perspective view of a refrigerator according to another embodiment.

FIG. 25 is a perspective view of a refrigerator according to another embodiment.

As illustrated in the drawing, a refrigerator 1 according to another embodiment may include a cabinet 10 having a storage space that is vertically partitioned and a door 2 opening and closing the storage space.

The door 2 may include a rotation door 20 which is provided in an upper portion of a front surface of the cabinet 10 to open and close an upper storage space and a drawer door 30 disposed in a lower portion of the front surface of the cabinet 10 to open and close a lower storage space. The drawer door 30 may be inserted and withdrawn forward and backward like the foregoing embodiment. In the state in which the drawer door 30 is withdrawn, the support member 35 within the drawer door 30 may be vertically elevated.

A manipulation part 301 or a manipulation device 302 may be provided at one side of the front panel door part 31. The insertion and withdrawal of the drawer door 30 and/or the elevation of the support member 35 may be realized by manipulating the manipulation part 301 or the manipulation device 302.

The support member 35 may be provided in the drawer part 32. The support member 35 may be elevated by driving the elevation assembly provided in the front panel door part 31 and the drawer part 32. Since the structure of the drawer door 30 and the structure of the elevation assembly 40 are the same as those according to the foregoing embodiment, their detailed descriptions will be omitted.

A plurality of containers 361 may be provided in the support member 35. The container 361 may be a sealed container such as a kimchi passage, and a plurality of the containers 361 may be seated on the support member 35. The container 361 may be elevated together with the support member 35 when the support member 35 is elevated. Thus, in the state in which the container 361 ascends, at least a portion of the drawer part 32 may protrude, and thus, the user may easily lift the container 361.

The support member 35 may interfere with the rotation door 20 in the rotation door 20 is opened even though the drawer door 30 is withdrawn. Thus, the support member 35 may ascend in a state in which the rotation door 20 is closed. For this, a door switch for detecting the opening/closing of the rotation door 20 may be further provided.

Figure 26:
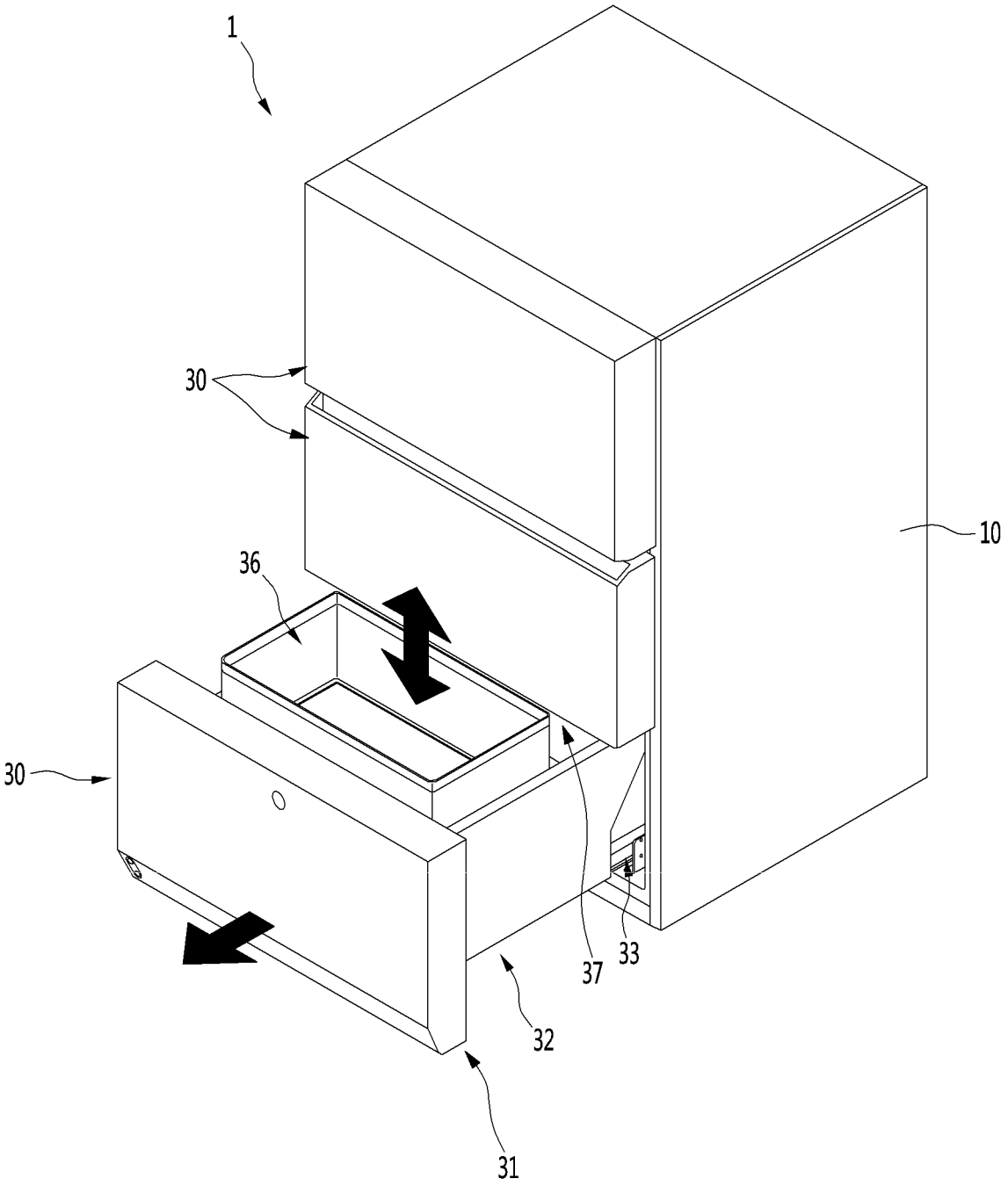
FIG. 26 is a perspective view of a refrigerator according to another embodiment.

FIG. 26 is a perspective view of a refrigerator according to another embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of drawer doors 30 may be continuously disposed in a vertical direction. The drawer doors 30 may be independently inserted and withdrawn by user's manipulation. A support member 35 within the drawer door 30 may be elevated. The insertion and withdrawal of the drawer door 30 and the elevation of the support member 35 may be individually performed. After the drawer door 30 is withdrawn, the support member 35 may ascend. Then, after the support member descends, the insertion of the drawer door 30 may be continuously performed.

Also, when the plurality of drawer doors 30 are vertically arranged, the support member 35 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the support member 35 ascends in the state in which the drawer door 30 that is disposed at the uppermost side is withdrawn in FIG. 26, all of the drawer doors 30 disposed at the upper side may also be elevated by the support members 35 provided inside.

If a height of each of the drawer doors 30 disposed at the upper side is sufficiently high, only the drawer door 30 disposed at the lowermost position or the support member 35 of the plurality of drawer doors 30 disposed relatively downward may be elevated.

Figure 27:
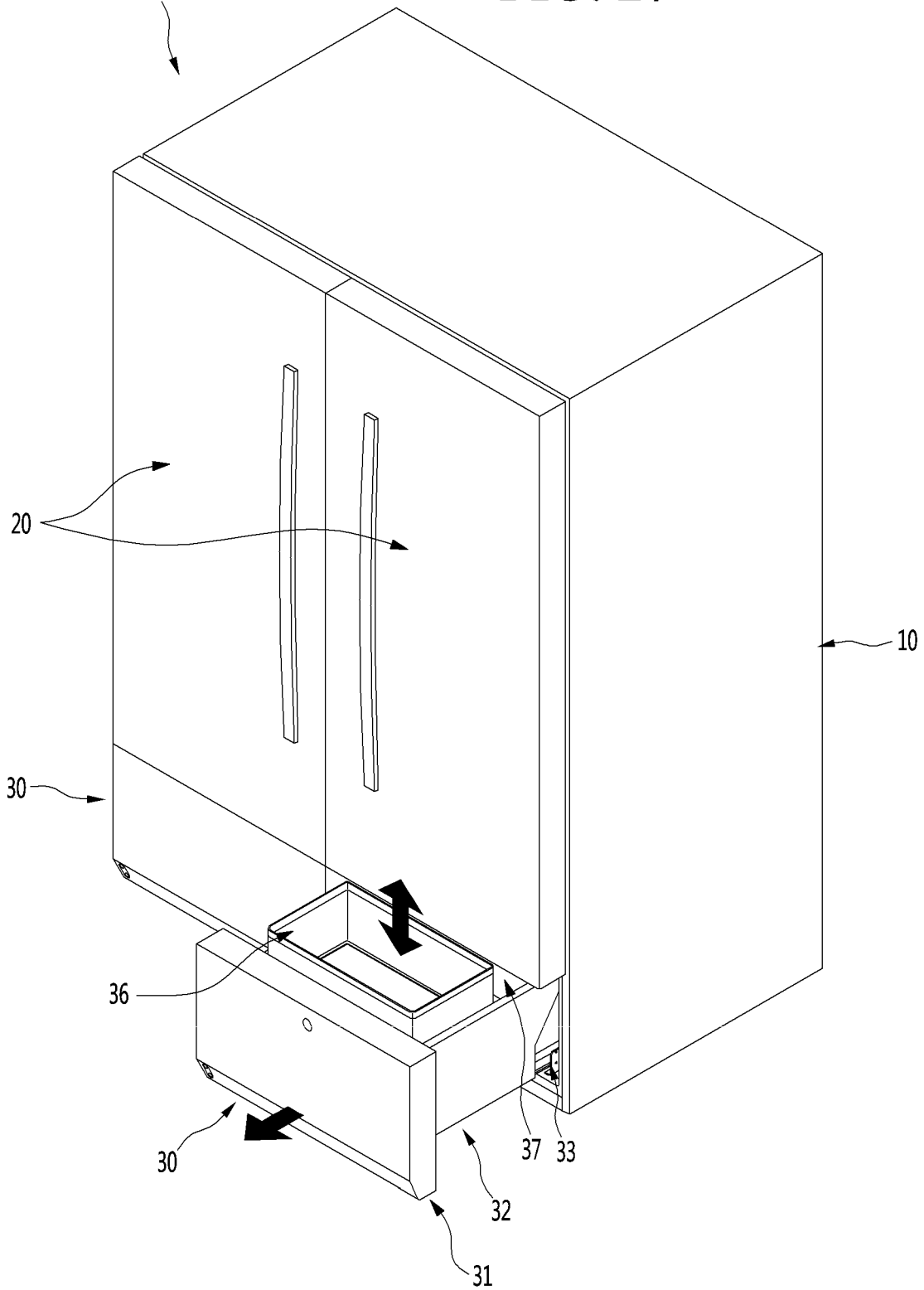
FIG. 27 is a perspective view of a refrigerator according to another embodiment.

FIG. 27 is a perspective view of a refrigerator according to another embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The inside of the cabinet 10 may be divided into an upper space and a lower space. If necessary, the upper and lower storage spaces may be divided again into left and right spaces.

The door 2 may include a rotation door 20 which is provided in an upper portion of the cabinet 10 to open and close the upper storage space and a drawer door 2 disposed in a lower portion of the cabinet 10 to open and close the lower storage space.

Also, the lower space of the cabinet may be divided into left and right spaces. The drawer door 30 may be provided in a pair so that the pair of drawer doors 30 respectively open and close the lower spaces. The pair of drawer doors 30 may be disposed in parallel to each other at left and right sides. The drawer doors 30 may have the same structure.

The drawer door 30 may have the same structure as the drawer door according to the foregoing embodiment. Thus, the drawer door 30 may be inserted and withdrawn by user's manipulation. In the drawer door 30 is withdrawn, the support member 35 may ascend so that a user more easily accesses a food or container within the drawer door 30.

The following effects may be expected in the refrigerator according to the proposed embodiments.

The refrigerator according to the embodiment, a portion of the accommodation space within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the support member within the drawer door may ascend up to a convenient position by driving the elevation assembly to prevent the user from being injured and significantly improve the convenience in use.

Also, the support member on which the food or the container is seated may be disposed in the drawer door, and the elevation assembly may be provided on both the sides of the drawer door to elevate the support member. Thus, the support member may be elevated in the state in which both ends of the support member are supported. Thus, the support member may be prevented from being eccentric or tilted to secure the stable elevation and the operation reliability.

Also, the support member may constitute a portion of the space within the drawer part and be disposed in the front space of the drawer part to elevate the support member in the state in which the drawer part is withdrawn so that only the front space is disposed to the outside without withdrawing the entire drawer part. Thus, the instability due to the excessive withdrawal of the drawer part may be solved, and the additional constituent for supporting the load may be unnecessary, and also, the loss of the cold air to the outside due to the withdrawal of the entire drawer part may be prevented.

Also, the drawer door may include the front panel door part defining the front surface of the door and the drawer part defining the accommodation space, and the front panel door part and the drawer part may be coupled to be separated from each other. Also, the support member may include the door-side device provided in the front panel door part and the drawer-side device provided in the drawer part. When the front panel door part and the drawer part are coupled to each other, the door-side device and the drawer-side device may be connected to each other to transmit the power. Thus, the assemblability and the service performance of the drawer door may be improved.

Also, the electrical device, to which the power is supplied, such as the elevation motor may be disposed in the door-side device, and only the mechanism-side of the drawer-side device may be disposed to secure the user's safety. Also, the separation of the drawer par and the arrangement of the electrical device may be performed on the drawer part to improve the cleanability of the drawer part.

Also, the drawer-side device disposed in the drawer part may be connected to the center of both the ends of the support member that is elevated in the drawer part. Thus, the support member may not be lean or tilted to one side until the food and the container, which are accommodated in the drawer part. Thus, the support member may be stably elevated.

Also, the elevation device constituting the drawer-side device may transmit the power and also be prevented from moving in the front/rear and left/right directions to more stably elevate the support member.

Also, all of the elevation device constituting the elevation assembly, the drawer-side shaft for transmitting the power, and the draw-out rail for inserting and withdrawing the drawer part may be disposed on the side area of the drawer part. Particularly, the mounting part, and the shaft mounting part, and the rail mounting part may be disposed in a lower region of the drawer flange that is bent laterally from the upper end of the drawer part so that the mounting part, and the shaft mounting part, and the rail mounting part do not further protrude from the drawer flange.

That is, the elevation device, the drawer shaft, and the draw-out rail may be disposed on the lower region defined by the drawer flange. Thus, additional constituents for mounting the constituents for the elevation may be not required to generally prevent the storage loss of the drawer part from occurring.

Also, the motor assembly constituting the elevation assembly may be disposed in the front panel door part to minimize the reduction in volume of the drawer part due to the installation of the elevation assembly.

Furthermore, the inner and outer surfaces of the drawer part may be provided with the plurality of plates for covering the constituents mounted on the drawer part and simultaneously allowing the inner and outer appearances of the drawer door to have the metal texture, thereby realizing the elegant outer appearance.

Particularly, in the case of the outer side plate defining the outer surface of the drawer part, the draw-out rail mounted on the outer surface of the drawer part and the drawer-side shaft may be completely covered to improve the outer appearance of the drawer part.

Also, the draw-out rail may be disposed on the lower end of the drawer part on both side surfaces of the drawer part, and the elevation device may extend from the upper end of the drawer part up to the draw-out rail so that the drawer part is maximally withdrawn, and the elevation device is elevated at the maximum height without allowing the draw-out rail of the drawer part and the elevation of the support member to interfere with each other.

Furthermore, all of the elevation device and the draw-out rail may be disposed in the same space on the side surface of the drawer part to provide the structure in which the draw-out distance and the elevation height are secured and simultaneously prevent the loss in capacity within the drawer part from occurring.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet that defines a storage space;

a front door panel configured to open and close at least a portion of the storage space;

an elevation motor installed on a rear surface of the front door panel;

a drawer coupled to the front door panel and configured to insert into and withdraw from the storage space, the drawer being configured to accommodate a food container;

an elevation device installed on the drawer and configured to elevate the food container;

a drawer-side shaft connected to the elevation device; and a door-side shaft connected to the elevation motor, wherein driving power of the elevation motor is transferred through the door-side shaft and the drawer-side shaft to the elevation device.

2. The refrigerator according to claim 1, further comprising a support member disposed in the drawer and configured to support the food container, wherein the elevation device is connected to ends of the support member and configured to elevate the support member relative to a bottom surface of the drawer.

3. The refrigerator according to claim 1, wherein the door-side shaft extends in a first direction from the elevation motor, and wherein the drawer-side shaft is disposed at the elevation device and connected to the door-side shaft, the drawer-side shaft extending in a second direction crossing the first direction.

4. The refrigerator according to claim 3, wherein the door-side shaft extends in the first direction across the front door panel, and wherein the drawer-side shaft extends in the second direction toward the storage space.

5. The refrigerator according to claim 1, wherein the drawer comprises an elevation device mount that is recessed from an inner surface of the drawer and that has a shape corresponding to the elevation device.

6. The refrigerator according to claim 1, wherein the front door panel defines a recess at the rear surface of the front door panel, the recess accommodating the elevation motor.

7. The refrigerator according to claim 1, further comprising a door cover that is disposed at the rear surface of the front door panel and that covers the elevation motor and the door-side shaft.

8. The refrigerator according to claim 7, wherein the front door panel defines a recess at the rear surface of the front door panel, the recess accommodating the elevation motor, and wherein the door cover covers the recess.

9. The refrigerator according to claim 2, wherein the elevation device comprises:

a housing coupled to the drawer;

an elevation shaft that is rotatably located inside of the housing, that extends in a vertical direction, and that defines a screw thread at an outer circumferential surface thereof;

an elevation holder that is penetrated by the elevation shaft, that is located inside of the housing, and that is configured to move along the elevation shaft in the vertical direction; and a connecting bracket that protrudes to an outside of the drawer and that connects the elevation holder to sides of the support member.

10. The refrigerator according to claim 9, wherein the elevation motor and the door-side shaft are disposed at the front door panel, and wherein the refrigerator further comprises:

a door-side first gear disposed at an end of the door-side shaft, a door-side second gear engaged with the door-side first gear, and a door connection member coupled to the door-side second gear.

11. The refrigerator according to claim 10, wherein the drawer-side shaft comprises:

a drawer shaft, a drawer connection member disposed at a front end of the drawer shaft, and a drawer-side gear disposed at a rear end of the drawer shaft.

12. The refrigerator according to claim 11, wherein the door connection member is exposed to the rear surface of the front door panel, wherein the drawer connection member is disposed at a position corresponding to the door connection member and exposed to a front surface of the drawer, wherein a shape of the door connection member corresponds to a shape of the drawer connection member, wherein the door connection member and the drawer connection member are configured to couple to each other and to separate from each other, and wherein the door connection member is configured to, based on coupling to the drawer connection member, transfer the driving power from the door-side shaft to the drawer connection member.

13. The refrigerator according to claim 12, wherein an outer diameter of the door connection member is equal to an outer diameter of the drawer connection member.

14. The refrigerator according to claim 12, further comprising:

a shaft gear disposed at an upper end of the screw thread of the elevation shaft and coupled to the elevation shaft, the shaft gear being configured to rotate together with the elevation shaft, wherein the shaft gear is gear-coupled to the drawer-side shaft, and wherein rotation axes of the shaft gear and the drawer-side gear cross each other.

15. The refrigerator according to claim 14, wherein the drawer-side shaft is connected to the elevation shaft and configured to transmit the driving power to the elevation shaft through the drawer-side gear and the shaft gear.

16. The refrigerator according to claim 15, wherein the door-side shaft is configured to, based on the elevation motor being driven, transmit rotation force of the door-side shaft to the drawer-side shaft through the door connection member and the drawer connection member.

17. The refrigerator according to claim 16, wherein the elevation shaft is configured to rotate based on the drawer-side shaft being rotated by the drawer connection member, and wherein the elevation holder is configured to, based on rotation of the elevation shaft, move along the elevation shaft in the vertical direction.

18. The refrigerator according to claim 2, further comprising a height detection device configured to detect a position of the support member, and wherein the elevation motor is configured to stop driving the door-side shaft based on the height detection device detecting that the support member is located at a maximum height position of the support member.

19. The refrigerator according to claim 18, wherein the height detection device comprises a switch or a magnet.

20. The refrigerator according to claim 18, wherein the height detection device is configured to detect the maximum height position of the support member based on a variation of load applied to the elevation motor.

* * * * *